US008805226B2

(12) United States Patent
Baba

(10) Patent No.: US 8,805,226 B2
(45) Date of Patent: Aug. 12, 2014

(54) FIXING DEVICE HAVING FIXING-MEMBER MOVING UNIT, HEATING DEVICE HAVING FIXING-MEMBER MOVING UNIT, AND IMAGE FORMING APPARATUS HAVING FIXING-MEMBER MOVING UNIT

(75) Inventor: Motofumi Baba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 208 days.

(21) Appl. No.: 13/365,891

(22) Filed: Feb. 3, 2012

(65) Prior Publication Data

US 2012/0321333 A1 Dec. 20, 2012

(30) Foreign Application Priority Data

Jun. 16, 2011 (JP) ..... 2011-134521
Jul. 27, 2011 (JP) ..... 2011-164165

(51) Int. Cl.
*G03G 15/20* (2006.01)

(52) U.S. Cl.
CPC ..... *G03G 15/2032* (2013.01)
USPC ..... 399/69; 399/67

(58) Field of Classification Search
CPC ..... G03G 15/2032
USPC ..... 399/69
See application file for complete search history.

(56) References Cited

U.S. PATENT DOCUMENTS 5,493,378 A * 2/1996 Jamzadeh et al. ..... 399/328
8,180,240 B2 * 5/2012 Cao et al. ..... 399/70
2008/0181623 A1 * 7/2008 Hasegawa ..... 399/13
2009/0290916 A1 * 11/2009 Baba ..... 399/329
2011/0188875 A1 * 8/2011 Nakayama ..... 399/69
2012/0224895 A1 * 9/2012 Baba et al. ..... 399/329

FOREIGN PATENT DOCUMENTS

JP 06027853 A * 2/1994
JP 08-286549 A 11/1996
JP 2009-282413 A 12/2009

* cited by examiner

*Primary Examiner* — David Gray
*Assistant Examiner* — Tyler Hardman
(74) *Attorney, Agent, or Firm* — Sughrue Mion, PLLC

(57) ABSTRACT

A fixing device includes a fixing member that is able to circulate and fixes an image on a recording material to the recording material; a heated member that is at least partly separated from the fixing member; a heating unit that heats the fixing member and the heated member; a heated-member moving unit that moves the heated member toward the fixing member; and a fixing-member moving unit that moves the fixing member at a first speed, and moves the fixing member at a second speed higher than the first speed after the heated member is moved.

18 Claims, 21 Drawing Sheets

FIG. 18

| | HEAT-GENERATION RATIO | | TIME UNTIL FIXING IS ABLE TO BE STARTED (SEC) |
|---|---|---|---|
| | FIXING BELT | TEMPERATURE-SENSITIVE MAGNETIC MEMBER | |
| FIXING DEVICE 100 IN FIG. 17 | 10 | 0 | 3 |
| FIXING DEVICE 100 IN FIG. 2 | 7 TO 8 | 2 TO 3 | 4 TO 6 |

FIXING DEVICE HAVING FIXING-MEMBER MOVING UNIT, HEATING DEVICE HAVING FIXING-MEMBER MOVING UNIT, AND IMAGE FORMING APPARATUS HAVING FIXING-MEMBER MOVING UNIT

CROSS-REFERENCE TO RELATED APPLICATIONS

This application is based on and claims priority under 35 USC 119 from Japanese Patent Application No. 2011-134521 filed Jun. 16, 2011 and No. 2011-164165 filed Jul. 27, 2011.

BACKGROUND

The present invention relates to a fixing device, a heating device, and an image forming apparatus.

SUMMARY

According to an aspect of the invention, there is provided a fixing device including a fixing member that is able to circulate and fixes an image on a recording material to the recording material; a heated member that is at least partly separated from the fixing member; a heating unit that heats the fixing member and the heated member; a heated-member moving unit that moves the heated member toward the fixing member; and a fixing-member moving unit that moves the fixing member at a first speed, and moves the fixing member at a second speed higher than the first speed after the heated member is moved.

BRIEF DESCRIPTION OF THE DRAWINGS

Exemplary embodiment(s) of the present invention will be described in detail based on the following figures, wherein:

FIG. 18 is an illustration for explaining a heat-generation ratio etc. of the fixing belt and the temperature-sensitive magnetic member;

DETAILED DESCRIPTION

An exemplary embodiment of the present invention will be described below with reference to the accompanying figures.

Figure 1:
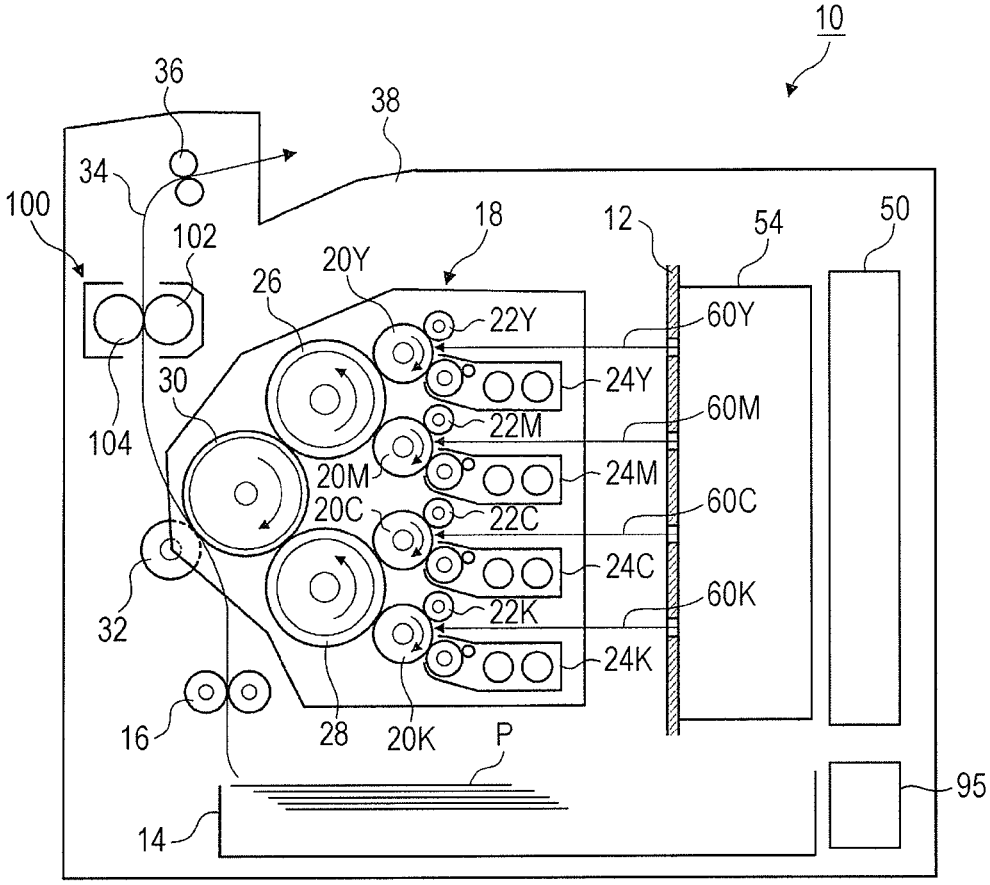
FIG. 1 is an illustration showing a printer according to an exemplary embodiment.

FIG. 1 is an illustration showing a printer 10 according to this exemplary embodiment.

The printer 10 as an example of an image forming apparatus includes a housing 12 that forms a body of the printer 10. The printer 10 includes a light-scanning device 54. The light-scanning device 54 is fixed to the housing 12. The printer 10 includes a control unit 50 provided at a position next to the light-scanning device 54. The control unit 50 controls an operation of the light-scanning device 54 and operations of respective units of the printer 10. Further, the printer 10 includes a power supply unit 95 that supplies electric power to respective units and respective devices of the printer 10.

The light-scanning device 54 performs scanning with a light beam emitted from a light source (not shown) by using a rotatable polygonal mirror, reflects the light beam by using plural optical components such as reflection mirrors, and hence emits light beams 60Y, 60M, 60C, and 60K respectively corresponding to toners of yellow (Y), magenta (M), cyan (C), and black (K). The light beams 60Y, 60M, 60C, and 60K are respectively guided to corresponding photoconductor drums 20Y, 20M, 20C, and 20K. In the printer 10 according to this exemplary embodiment, a sheet housing portion 14 is provided in a lower section of the printer 10. The sheet housing portion 14 houses sheets P as an example of a recording material.

Further, a pair of registration rollers 16 is provided above the sheet housing portion 14. The registration rollers 16 adjust a position of a tip end of a sheet P. Though not shown, a feed roller is provided. The feed roller comes into contact with a top sheet P from among the plural sheets P housed in the sheet housing portion 14, and feeds the sheet P toward the registration rollers 16. In this exemplary embodiment, an image forming device 18 that functions as part of an image forming device is provided at a center portion of the printer 10. The image forming device 18 includes the four photoconductor drums 20Y, 20M, 20C, and 20K. The four photoconductor drums 20Y, 20M, 20C, and 20K are arranged in line in a vertical direction.

Charging rollers 22Y, 22M, 22C, and 22K that electrically charge surfaces of the photoconductor drums 20Y, 20M, 20C, and 20K are provided at upstream sides in rotation directions of the photoconductor drums 20Y, 20M, 20C, and 20K. Developing devices 24Y, 24M, 24C, and 24K that develop electrostatic latent images formed on the photoconductor drums 20Y, 20M, 20C, and 20K with the toners of Y, M, C, and K are provided at downstream sides in the rotation directions of the photoconductor drums 20Y, 20M, 20C, and 20K. Also, in this exemplary embodiment, a first intermediate transfer member 26 that comes into contact with the photoconductor drums 20Y and 20M, and a second intermediate transfer member 28 that comes into contact with the photoconductor drums 20C and 20K are provided.

Further, a third intermediate transfer member 30 that comes into contact with the first intermediate transfer member 26 and the second intermediate transfer member 28 is provided. A transfer roller 32 is provided at a position at which the transfer roller 32 faces the third intermediate transfer member 30. In this exemplary embodiment, toner images on the photoconductor drums 20Y and 20M are transferred on the first intermediate transfer member 26, and toner images on the photoconductor drums 20C and 20K are transferred on the second intermediate transfer member 28. Then, the toner images transferred on the first intermediate transfer member 26 and the toner images transferred on the second intermediate transfer member 28 are transferred on a sheet P through the third intermediate transfer member 30.

Also, in this exemplary embodiment, a fixing device 100 is provided in a sheet transport path 34 in which a sheet P is transported and is located downstream of the transfer roller 32 in a transport direction of the sheet P. The fixing device 100 includes a pressure roller 104 and a fixing belt 102, which is an example of a fixing member. The fixing device 100 fixes a toner image to the sheet P by heating and pressing the sheet P. The sheet P to which the toner image is fixed is output to a sheet output portion 38 by sheet transport rollers 36. The sheet output portion 38 is provided in an upper section of the printer 10.

Now, an image formation operation executed by the printer 10 is described.

When the image formation operation is started, the charging rollers 22Y to 22K electrically charge the surfaces of the photoconductor drums 20Y to 20K. The light-scanning device 54 irradiates the surfaces of the photoconductor drums 20Y to 20K after charging, with the light beams 60Y to 60K corresponding to an output image. Hence, electrostatic latent images corresponding to images of the respective colors are formed on the photoconductor drums 20Y to 20K. The developing devices 24Y to 24K supply the toners to the electrostatic latent images. Toner images of the Y color to K color are formed on the photoconductor drums 20Y to 20K.

Then, a magenta toner image is first-transferred on the first intermediate transfer member 26 from the magenta photoconductor drum 20M. A yellow toner image is first-transferred on the first intermediate transfer member 26 from the yellow photoconductor drum 20Y. At this time, the yellow toner image is superposed on the magenta toner image which has been placed on the first intermediate transfer member 26. A black toner image is first-transferred on the second intermediate transfer member 28 from the black photoconductor drum 20K. A cyan toner image is first-transferred on the second intermediate transfer member 28 from the cyan photoconductor drum 20C. At this time, the cyan toner image is superposed on the black toner image which has been placed on the second intermediate transfer member 28.

Then, the magenta and yellow toner images which have been first-transferred on the first intermediate transfer member 26 are second-transferred on the third intermediate transfer member 30. Also, the black and cyan toner images which have been first-transferred on the second intermediate transfer member 28 are second-transferred on the third intermediate transfer member 30. The magenta and yellow toner images which have been second-transferred first and the cyan and black toner images which have been second-transferred next are superposed on each other on the third intermediate transfer member 30. Accordingly, a full-color toner image with colors (three colors) and black is formed on the third intermediate transfer member 30.

Then, the toner image on the third intermediate transfer member 30 reaches a nip part that is formed by the third intermediate transfer member 30 and the transfer roller 32. In synchronization with this timing, a sheet P is transported by the registration rollers 16 to the nip part. Accordingly, the full-color toner image is third-transferred (finally transferred) on the sheet P. Then, the sheet P is transported to the fixing device 100, and passes through a nip part that is formed by the fixing belt 102 and the pressure roller 104. At this time, by effects of the heat and pressure provided by the fixing belt 102 and pressure roller 104, the toner image is fixed to the sheet P. After fixing, the sheet P is output by the sheet transport rollers 36 onto the sheet output portion 38. Thus, the image formation on the sheet P is completed.

Now, the fixing device 100 is described in detail.

Figure 2:
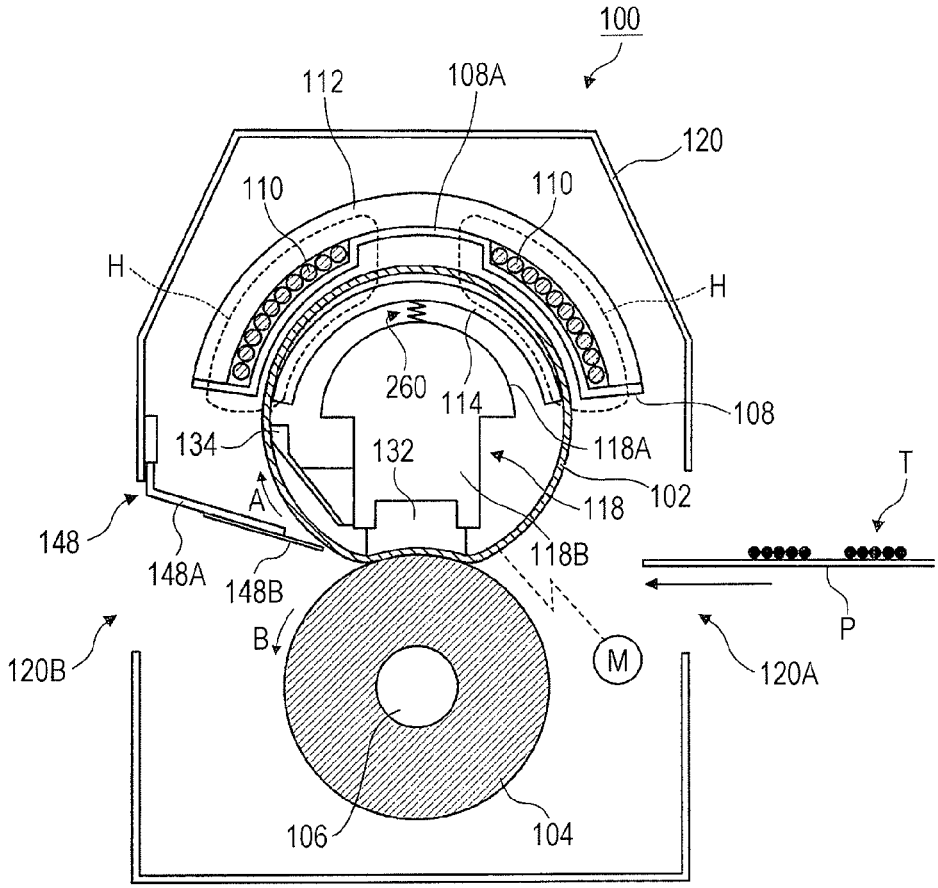
FIG. 2 is an illustration for explaining a fixing device.
Figure 3:
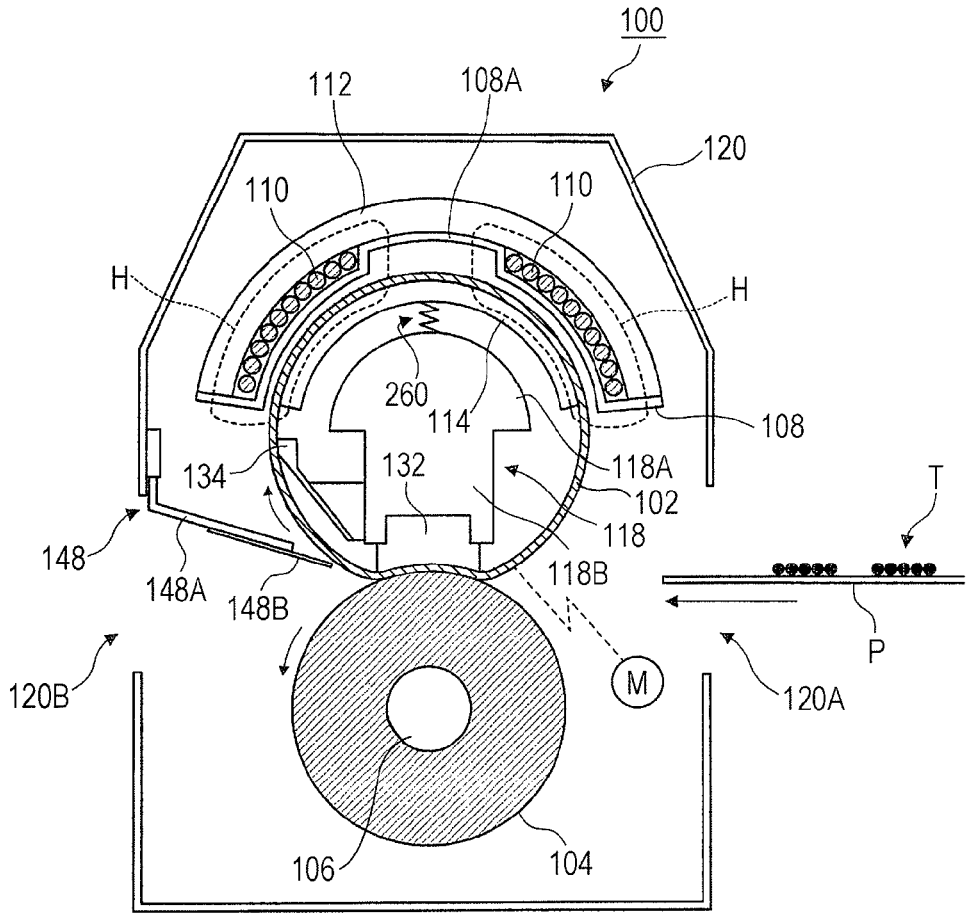
FIG. 3 is an illustration for explaining the fixing device.
Figure 4:
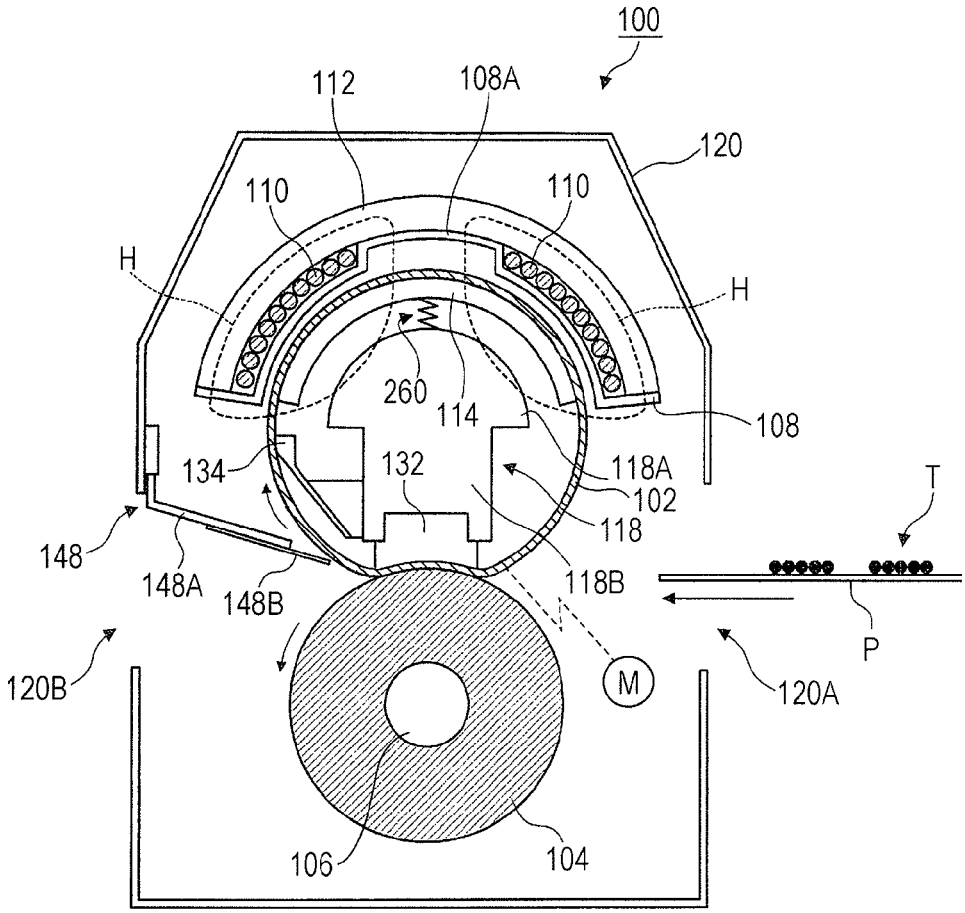
FIG. 4 is an illustration for explaining the fixing device.

FIGS. 2 to 4 are illustrations for explaining the fixing device 100.

As shown in FIG. 2, the fixing device 100 includes a housing 120. The housing 120 has a first opening 120A through which a transported sheet P enters, and a second opening 120B through which a sheet P after fixing processing is output. Also, the fixing device 100 includes the fixing belt 102 that is a cylindrical endless belt and circulates. The fixing belt 102 is rotatable in a direction indicated by arrow A in the figure around a center axis extending in the longitudinal direction of the fixing belt 102.

The fixing device 100 according to this exemplary embodiment includes a driving motor M that rotates the fixing belt 102. A bobbin 108 is arranged at a position at which the bobbin 108 faces an outer peripheral surface of the fixing belt 102. The bobbin 108 has an arc shape to extend along the outer peripheral surface of the fixing belt 102. The bobbin 108 has a protrusion 108A at a center portion of a surface opposite to a surface that faces the fixing belt 102. The distance between the bobbin 108 and the fixing belt 102 is in a range from about 1 to 3 mm. In the bobbin 108, an exciting coil 110 (an example of a heating unit) that generates a magnetic field (alternating magnetic field) H is wound around the protrusion 108A in the axial direction (in a depth direction of FIG. 2). A magnetic-material core 112 is arranged at a position at which the magnetic-material core 112 faces the exciting coil 110. The magnetic-material core 112 has an arc shape extending along the shape of the bobbin 108.

Now, a configuration of the fixing belt 102 is described.

Figure 5A:
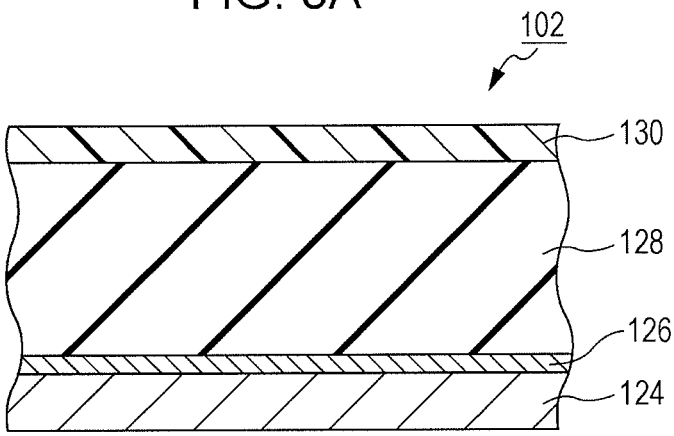
FIGS. 5A and 5B are illustrations showing a cross-sectional configuration etc. of a fixing belt.
Figure 5B:
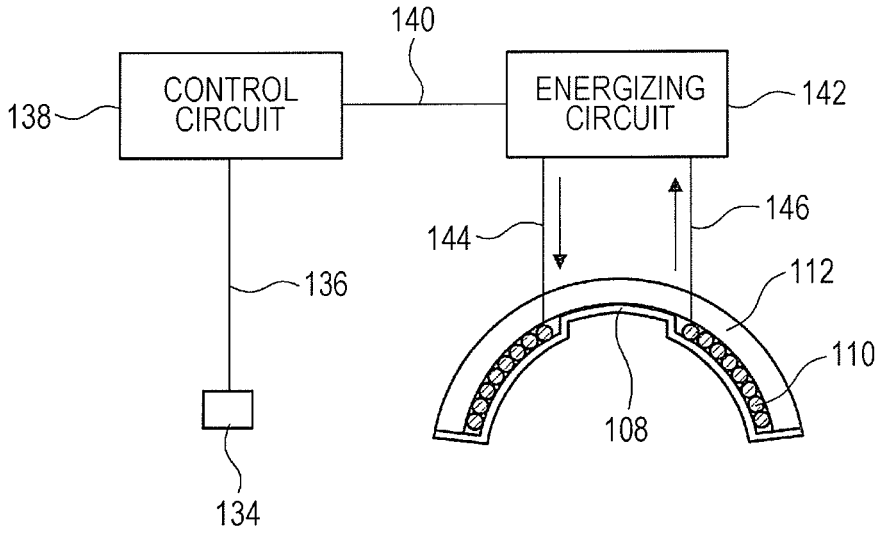

FIGS. 5A and 5B are illustrations showing a cross-sectional configuration etc. of the fixing belt 102. As shown in FIG. 5A, the fixing belt 102 includes a base layer 124, a heat-generating layer 126, an elastic layer 128, and a release layer 130. The base layer 124, the heat-generating layer 126, the elastic layer 128, and the release layer 130 are provided in that order from the inner peripheral surface side toward the outer peripheral surface side of the fixing belt 102. The fixing belt 102 of this exemplary embodiment has a diameter of 30 mm, and a length in the longitudinal direction (width direction) of 370 mm.

The base layer 124 may use a material having an intensity that allows the base layer 124 to support the thin heat-generating layer 126. The material is heat-resistant, and does not generate heat or hardly generates heat by an effect of a magnetic field while allowing a magnetic field (magnetic flux) to penetrate through the material. For example, a metal belt (of non-magnetic metal, e.g., non-magnetic stainless steel) with a thickness in a range from 30 to 200 μm or a belt formed of a metal material, such as Fe, Ni, Co, or an alloy of Fe—Ni—Co, Fe—Cr—Co, or the like, of these metals may be used. Alternatively, a resin belt (for example, a polyimide belt) with a thickness in a range from 60 to 200 μm may be used. In either case, the material (a specific resistance, a relative permeability) and thickness are determined so that the magnetic flux of the exciting coil 110 acts on a temperature-sensitive magnetic member 114 (described later). In this exemplary embodiment, non-magnetic stainless steel is used.

The heat-generating layer 126 that is an example of a conductive layer is formed of a metal material that generates heat by an electromagnetic induction effect in which the magnetic field (alternating magnetic field) H (see FIGS. 2 to 4) generated by the exciting coil 110 passes through the heat-generating layer 126 in the thickness direction and eddy current flows to generate a magnetic field that cancels the magnetic field H. Also, the heat-generating layer 126 is thinner than a skin depth that is a thickness through which the magnetic field H may enter, to allow the magnetic flux of the magnetic field H to penetrate through the heat-generating layer 126. When δ is a skin depth, $\rho_n$ is a specific resistance, $\mu_n$ is a relative permeability of the heat-generating layer 126, and f is a frequency of a signal (current) in the exciting coil 110, δ is expressed by Expression (1) as follows:

$$\delta = 503\sqrt{\frac{\rho_n}{f \cdot \mu_n}} \tag{1}$$

The metal material used for the heat-generating layer 126 is any of, for example, gold, silver, copper, aluminum, zinc, tin, lead, bismuth, beryllium, and antimony, or an alloy of these metals. To decrease a warm-up time of the fixing device 100, the thickness of the heat-generating layer 126 is desirably small. Also, a non-magnetic metal material (a paramagnetic material with a relative permeability of about 1) with a thickness in a range from 2 to 20 μm, and a specific resistance of $2.7\times10^{-8}$ Ω-cm or smaller may be used for the heat-generating layer 126 within a range of an alternating frequency from 20 to 100 kHz that is provided by a general power supply. In this exemplary embodiment, copper with a thickness of 10 μm is used for the heat-generating layer 126 because the material provides a required heat amount efficiently and decreases the cost.

The elastic layer 128 uses silicon rubber or fluorocarbon rubber because the material is elastic and heat-resistant. In this exemplary embodiment, silicon rubber is used. In this exemplary embodiment, the elastic layer 128 has a thickness of 200 μm. The thickness of the elastic layer 128 may be determined in a range from 200 to 600 μm.

The release layer 130 decreases a bonding force between the toner T on the sheet P (see FIG. 2) and the fixing belt 102, and causes the sheet P to be easily separated from the fixing belt 102. The release layer 130 may use fluorocarbon resin, silicon resin, or polyimide resin. In this exemplary embodiment, tetrafluoroethylene perfluoroalkoxy vinyl ether copolymer (PFA) is used. In this exemplary embodiment, the release layer 130 has a thickness of 30 μm.

Referring back to FIG. 2, the fixing device 100 is further described.

As shown in FIG. 2, the temperature-sensitive magnetic member 114 is provided inside the fixing belt 102. The temperature-sensitive magnetic member 114 which is an example of a heated member has an arc shape extending along the inner peripheral surface of the fixing belt 102, and is arranged to face the inner peripheral surface of the fixing belt 102. The temperature-sensitive magnetic member 114 is arranged to face the exciting coil 110 with the fixing belt 102 interposed therebetween. The temperature-sensitive magnetic member 114 is able to advance to and retract from the inner peripheral surface of the fixing belt 102. In particular, the temperature-sensitive magnetic member 114 is movable in the vertical direction in FIG. 2.

Figure 6A:
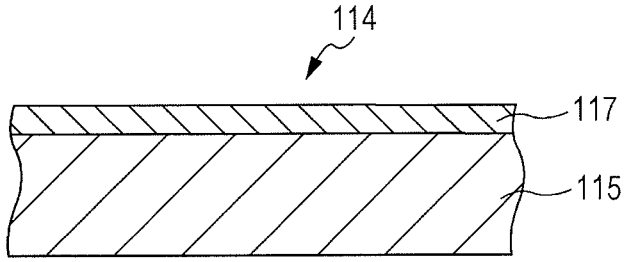
FIGS. 6A and 6B are illustrations for explaining a temperature-sensitive magnetic member.
Figure 6B:
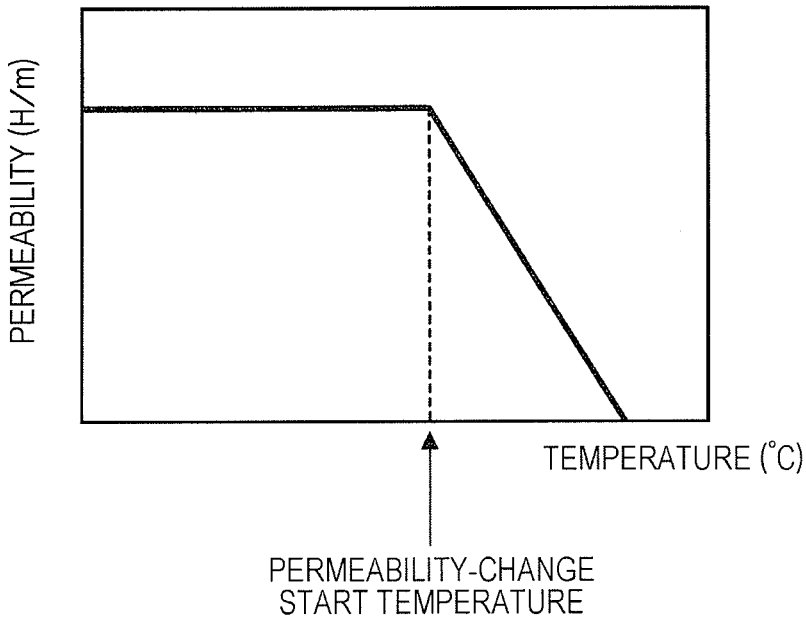

FIGS. 6A and 6B are illustrations for explaining the temperature-sensitive magnetic member 114.

As shown in FIG. 6A, the temperature-sensitive magnetic member 114 includes a temperature-sensitive layer 115 having a temperature-sensitive characteristic (described later) and serving as a base layer; and a heat-generating layer 117 stacked on a surface of the temperature-sensitive layer 115. In this exemplary embodiment, the heat-generating layer 117 is provided. However, if the temperature-sensitive layer 115 is enough to obtain a required heat amount, the heat-generating layer 117 may be omitted.

The temperature-sensitive layer 115 has a temperature-sensitive characteristic in which its permeability starts continuously decreasing from a permeability-change start temperature in a temperature region (temperature range) from a temperature equal to or higher than a fixing set temperature of the fixing belt 102 to a temperature equal to or lower than an upper temperature limit of the fixing belt 102. The temperature-sensitive layer 115 uses, for example, binary magnetic shunt steel such as a Fe—Ni alloy (permalloy), or ternary magnetic shunt steel such as a Fe—Ni—Cr alloy, having a permeability-change start temperature set within a range from 140° C. to 240° C. For example, in the case of Fe—Ni binary magnetic shunt steel, the permeability-change start temperature is set around 225° C. if Fe is about 64% and Ni is about 36% (atomic ratio). Alternatively, a metal alloy made of any of Fe, Ni, Si, B, Nb, Cu, Zr, Co, Cr, V, Mn, and Mo may be used for the material. In this exemplary embodiment, a Fe—Ni alloy with a thickness of 150 μm is used. The heat-generating layer 117 may use a material with a characteristic similar to that of the heat-generating layer 126 of the fixing belt 102. In this exemplary embodiment, the heat-generating layer 117 uses copper with a thickness of 20 μm.

If the heat amount of the temperature-sensitive magnetic member 114 is too large, a portion that blocks a major path of eddy current flowing through the temperature-sensitive magnetic member 114 may be provided to restrict the heat generated by the temperature-sensitive magnetic member 114. Specifically, the heat generated by the temperature-sensitive magnetic member 114 may be restricted by forming plural slits to cause the eddy current to hardly flow therethrough. The heat amount is adjustable by changing the number, width, length, and positions of the slits. Also, the slits are more effective if the slits are made in a direction substantially perpendicular to the path in which the eddy current flows.

Also, a non-magnetic metal layer with a low specific resistance may be provided on a surface of the temperature-sensitive magnetic member 114 opposite to a surface provided with the exciting coil 110. The non-magnetic metal layer has a function that equalizes a temperature distribution in the longitudinal direction (axial direction) of the temperature-sensitive magnetic member 114. In this case, a local increase in temperature is restricted. In a case in which the temperature of the temperature-sensitive layer 115 increases and the permeability continuously decreases at the permeability-change start temperature or higher, if many magnetic fluxes act on the non-magnetic metal layer, the heat amounts of the heat-generating layer 117 and temperature-sensitive layer 115 are restricted. This effect is similar to an effect provided by an inductive member 118 (described later). The material of the non-magnetic metal layer may be, for example, silver, copper, or aluminum.

As shown in FIG. 6B, the permeability-change start temperature is a temperature at which the permeability (measured under JIS C2531) starts continuously decreasing, and at which a penetrating amount of a magnetic flux of a magnetic field starts changing. The permeability-change start temperature is different from a Curie point, and is set in a range from 150° C. to 230° C.

Referring back to FIG. 2, the fixing device 100 is further described.

As shown in FIG. 2, the inductive member 118 is provided at the inner side of the temperature-sensitive magnetic member 114. The inductive member 118 has a thickness equal to or larger than the skin depth. The inductive member 118 may be a non-magnetic metal with a low specific resistance. For example, the inductive member 118 may use silver, copper, or aluminum. By selecting any of these materials and the thickness is equal to or larger than the skin depth, if a magnetic field acts on the inductive member 118, eddy current more easily flows through the inductive member 118 as compared with the heat-generating layer 117. The inductive member 118 includes an arc portion 118A that faces the inner peripheral surface of the temperature-sensitive magnetic member 114, and a column portion 118B that is integrally formed with the arc portion 118A.

The arc portion 118A of the inductive member 118 is arranged at a position at which, when the magnetic flux of the magnetic field H penetrates through the temperature-sensitive magnetic member 114, the arc portion 118A induces the magnetic flux of the magnetic field H. The inductive member 118 and the temperature-sensitive magnetic member 114 are provided separately from each other. In this exemplary embodiment, a pressing pad 132 is fixed at a lower end surface of the column portion 118B of the inductive member 118. The pressing pad 132 presses the fixing belt 102 outward. The pressing pad 132 is formed of an elastic member, such as urethane rubber or a sponge. An end surface of the pressing pad 132 is in contact with the inner peripheral surface of the fixing belt 102.

Also, in this exemplary embodiment, the pressure roller 104 is pressed to the outer peripheral surface of the fixing belt 102. The pressure roller 104 rotates in a direction indicated by arrow B in the figure by rotation of the fixing belt 102. The pressure roller 104 has an elastic layer around a core bar 106 made of metal such as aluminum. The elastic layer is made of a silicon rubber foam sponge and has a thickness of 5 mm. Also, a release layer is formed around the elastic layer. The release layer is made of PFA containing carbon and has a thickness of 50 μm. Further, in this exemplary embodiment, a retract mechanism is provided to swing a bracket that rotatably supports the pressure roller 104, by using a cam. Accordingly, the outer peripheral surface of the fixing belt 102 and the outer peripheral surface of the pressure roller 104 come into contact with each other and are separated from each other.

Also, in this exemplary embodiment, as shown in FIG. 2, a thermistor 134 is provided. The thermistor 134 is in contact with the inner peripheral surface of the fixing belt 102 and measures the surface temperature of the fixing belt 102. The thermistor 134 is provided in a region at an output side of a sheet P, the thermistor 134 not facing the exciting coil 110 in the region. The thermistor 134 measures the surface temperature of the fixing belt 102 by converting a resistance value that is changed in accordance with a heat amount of the heat given by the fixing belt 102 into a temperature. The thermistor 134 is provided to be in contact with a center portion in the longitudinal direction (width direction) of the fixing belt 102 so that the measurement value does not vary in accordance with the size of a sheet P.

As shown in FIG. 5B, the thermistor 134 is connected with a control circuit 138 that is provided in the control unit 50 (see FIG. 1) through a wire 136. The control circuit 138 is connected with an energizing circuit 142 through a wire 140. The energizing circuit 142 is connected with the exciting coil 110 through wires 144 and 146. The energizing circuit 142 is driven or stopped in response to an electric signal sent from the control circuit 138. The energizing circuit 142 supplies alternating current with a predetermined frequency to the exciting coil 110 or interrupts the supply, through the wires 144 and 146.

The control circuit 138 measures the surface temperature of the fixing belt 102 by performing temperature conversion based on an amount of electricity sent from the thermistor 134. Then, the measurement temperature is compared with a previously stored fixing set temperature (for example, 170° C.). If the measurement temperature is lower than the fixing set temperature, the energizing circuit 142 is driven, electricity is applied to the exciting coil 110, and hence the magnetic field H (see FIG. 2) is generated. In contrast, if the measurement temperature is higher than the fixing set temperature, the energizing circuit 142 is stopped.

As shown in FIG. 2, the fixing device 100 in this exemplary embodiment includes a guide member 148 located downstream of a contact part (nip part) between the fixing belt 102 and the pressure roller 104 in the transport direction of the sheet P. The guide member 148 includes a support portion 148A with an end thereof fixed, and a separate sheet 148B supported by the support portion 148A. The guide member 148 comes into contact with a tip end of a sheet P, which has been separated from the fixing belt 102, and guides the sheet P to the downstream side.

Figure 7:
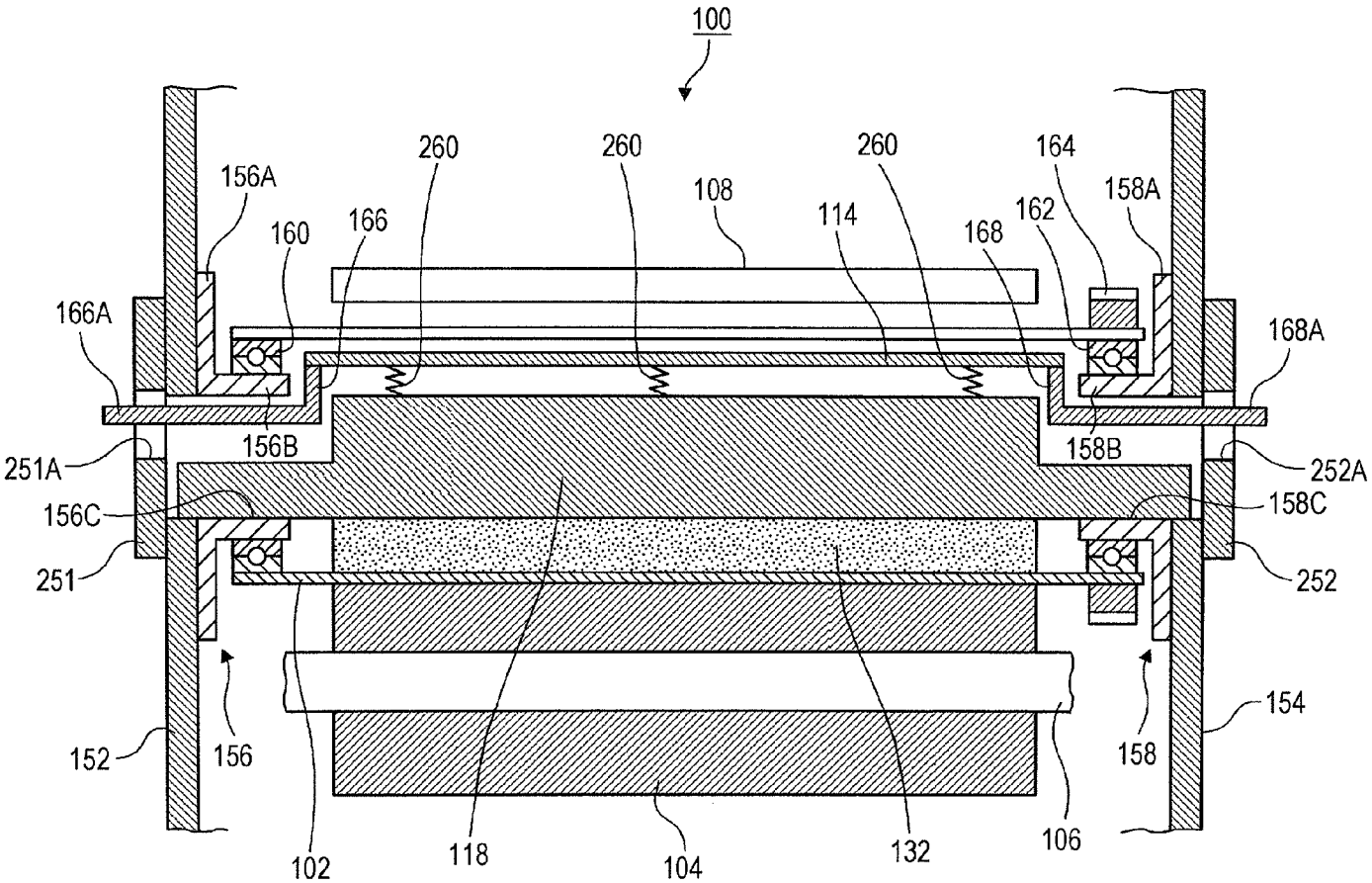
FIG. 7 is a sectional view of the fixing device when the fixing device is viewed from an upstream side in a sheet transport direction.
Figure 8:
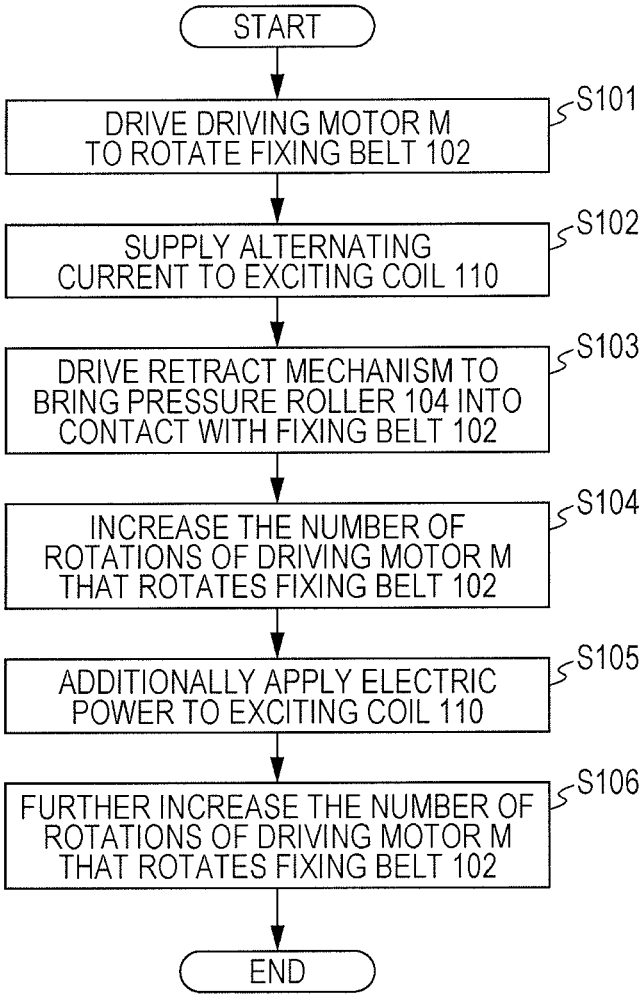
FIG. 8 is a flowchart showing processing executed by a control unit.

FIG. 7 is a sectional view of the fixing device 100 when the fixing device 100 is viewed from the upstream side in the transport direction of the sheet P.

The fixing device 100 is further described with reference to FIG. 7. As shown in the figure, a first side plate 152 is provided at a first end side of the fixing device 100, and a second side plate 154 is provided at a second end side. A first support member 156 is fixed to an inner wall surface of the first side plate 152. A second support member 158 is fixed to an inner wall surface of the second side plate 154. The first support member 156 has a flat plate portion 156A fixed to the first side plate 152, a cylindrical protruding portion 156B protruding from the flat plate portion 156A, and a through hole 156C penetrating through the flat plate portion 156A and the protruding portion 156B. Similarly, the second support member 158 has a flat plate portion 158A fixed to the second side plate 154, a protruding portion 158B protruding from the flat plate portion 158A, and a through hole 158C penetrating through the flat plate portion 158A and the protruding portion 158B.

In this exemplary embodiment, a bearing 160 is attached on an outer peripheral surface of the protruding portion 156B, and a bearing 162 is attached on an outer peripheral surface of the protruding portion 158B. In this exemplary embodiment, the inner peripheral surface of the fixing belt 102 is fixed to outer peripheral surfaces of the bearings 160 and 162. Thus, the fixing belt 102 is rotatable. Further, in this exemplary embodiment, a rotation-driving gear 164 is attached on a portion of the outer peripheral surface of the fixing belt 102, the portion which is located near the second side plate 154. In this exemplary embodiment, the gear 164 receives a driving force from the motor M (see FIG. 2) and hence the fixing belt 102 rotates.

The temperature-sensitive magnetic member 114 is provided to extend in the longitudinal direction (width direction) of the fixing belt 102 as shown in FIG. 7. Also, in this exemplary embodiment, support members 166 and 168 are attached at both end portions of the temperature-sensitive magnetic member 114. The support members 166 and 168 have L-shaped cross sections. The support members 166 and 168 are formed of a member with a low thermal conductivity. Hence, the heat of the temperature-sensitive magnetic member 114 is hardly transferred to the support members 166 and 168.

The support member 166 is provided in a state in which the support member 166 passes through the through hole 156C and part of the support member 166 protrudes outside the first side plate 152. The support member 168 is provided in a state in which the support member 168 passes through the through hole 158C and part of the support member 168 protrudes outside the second side plate 154. In this exemplary embodiment, a first end portion of the inductive member 118 in the longitudinal direction is inserted into the through hole 156C and is fixed to the first support member 156. A second end portion of the inductive member 118 in the longitudinal direction is inserted into the through hole 158C and is fixed to the second support member 158.

In this exemplary embodiment, a deformable member 260 is provided between the temperature-sensitive magnetic member 114 and the inductive member 118 (see also FIG. 2). The deformable member 260 is deformed when receiving heat from the temperature-sensitive magnetic member 114. Plural deformable members 260 functioning as a heated-member moving unit are provided. The deformable members 260 are arranged at positions shifted from each other in the longitudinal direction (width direction) of the fixing belt 102.

In this exemplary embodiment, a first guide member 251 and a second guide member 252 are provided. The first guide member 251 and the second guide member 252 are moved by expansion/contraction of the deformable members 260 (the detail will be described later) and guide the temperature-sensitive magnetic member 114. The first guide member 251 has a long hole 251A through which the support member 166 protruding from the first side plate 152 passes. The first guide member 251 comes into contact with the support member 166 inserted through the long hole 251A to guide the temperature-sensitive magnetic member 114. The second guide member 252 has a long hole 252A through which the support member 168 protruding from the second side plate 154 passes. The second guide member 252 comes into contact with the support member 168 inserted through the long hole 252A to guide the temperature-sensitive magnetic member 114.

The deformable members 260 have coil-spring-like shapes. The deformable members 260 are formed of a shape memory alloy. A shape memory alloy is metal (alloy) that has a shape memory effect in which the shape of the alloy is recovered to the original shape only by heating the alloy at a transformation temperature of that alloy or higher even if large deformation is applied to the alloy, the deformation which is non-recoverable in a case of a normal metal material. A currently practically used alloy is typically a titanium-nickel alloy. There are ten or more types of shape memory alloys with shape memory effects, such as a copper-zinc-nickel alloy or a nickel-aluminum alloy.

The transformation temperature of a shape memory alloy may be adjusted, for example, in a range from −20° C. to 100° C. by adjusting a titanium-nickel mixing ratio or by adding cobalt or copper by a very small amount. The deformable member 260 in this exemplary embodiment is treated with two-way shape memory processing. The deformable member 260 expands when the deformable member 260 receives heat from the temperature-sensitive magnetic member 114 and the temperature of the deformable member 260 becomes a predetermined temperature (transformation temperature, in this exemplary embodiment, 100° C.), and the deformable member 260 contracts when the temperature of the deformable member 260 becomes lower than the predetermined temperature.

Next, a series of operations during fixing processing performed by the fixing device 100 is described with reference to FIGS. 2 to 4, and 8 (a flowchart showing processing executed by the control unit 50). To be more specific, processing executed when power is turned on or when a state is recovered from an energy-saving mode is described.

For example, when power is turned on, the control unit 50 drives the driving motor M (see FIG. 2) to rotate the fixing belt 102 in the direction indicated by arrow A in FIG. 2 (step S101). At this time, the deformable member 260 contracts, and the temperature-sensitive magnetic member 114 is separated from the fixing belt 102. Then, the control unit 50 supplies alternating current to the exciting coil 110 through the control circuit 138 and the energizing circuit 142 (step S102). Hence, generation of magnetic fields H that intersect with the heat-generating layer 126 of the fixing belt 102 (see FIG. 5A) and vanishing of the magnetic fields H are repeated.

When the magnetic fields H pass across the heat-generating layer 126 of the fixing belt 102, eddy current is generated at the heat-generating layer 126 so as to generate magnetic fields that disturb a change in magnetic fields H. Accordingly, the fixing belt 102 is heated. When the fixing belt 102 is heated in this way, the temperature-sensitive magnetic member 114 is separated from the fixing belt 102. Accordingly, the heat of the fixing belt 102 is hardly reduced by the temperature-sensitive magnetic member 114, and the temperature of the fixing belt 102 quickly increases. Also in this exemplary embodiment, when the fixing belt 102 is heated, the magnetic fields H enter the temperature-sensitive magnetic member 114, and hence the temperature-sensitive magnetic member 114 is also heated.

The thermistor 134 detects the temperature at the surface of the fixing belt 102. If the temperature does not reach the fixing set temperature (for example, 170° C.), the control circuit 138 controls driving of the energizing circuit 142, and supplies alternating current with a predetermined frequency to the exciting coil 110. In contrast, if the temperature reaches the fixing set temperature, the control circuit 138 outputs a control signal to the energizing circuit 142 and stops the supply of the alternating current. Then, in this exemplary embodiment, when the temperature of the fixing belt 102 reaches the fixing set temperature, the control unit 50 drives the retract mechanism (not shown) to bring the pressure roller 104 into contact with the fixing belt 102 (step S103). Hence, the pressure roller 104 rotates together with the rotating fixing belt 102.

Then, a sheet P is fed to the fixing device 100, and the fed sheet P is heated and pressed by the fixing belt 102 at the predetermined fixing set temperature (170° C.) and the pressure roller 104. Accordingly, a toner image is fixed to the sheet P. Then, the sheet P is output to the sheet output portion 38 by the sheet transport rollers 36.

In this exemplary embodiment, when the fixing processing is performed for a first sheet P, the heat of the fixing belt 102 is reduced by the sheet P. Also, when second and later sheets P are successively supplied, the heat of the fixing belt 102 is further reduced. Owing to this, in this exemplary embodiment, as the fixing processing is continuously performed for the sheets P, the temperature of the fixing belt 102 gradually decreases. Meanwhile, in this exemplary embodiment, the temperature-sensitive magnetic member 114 is heated while the temperature-sensitive magnetic member 114 is separated from the fixing belt 102. Thus, in the fixing device 100 of this exemplary embodiment, the temperature of the fixing belt 102 decreases whereas the temperature of the temperature-sensitive magnetic member 114 increases.

In this exemplary embodiment, as the temperature of the temperature-sensitive magnetic member 114 increases, the temperature of the deformable member 260 increases. When the temperature of the deformable member 260 becomes, for example, 100° C. (when the temperature of the deformable member 260 exceeds the transformation temperature), the deformable member 260 starts expanding toward the inner peripheral surface of the fixing belt 102. In this exemplary embodiment, when the temperature of the deformable member 260 becomes 100° C., the temperature of the temperature-sensitive magnetic member 114 is about 185° C. When the deformable member 260 expands, the deformable member 260 moves the temperature-sensitive magnetic member 114. As shown in FIG. 3, the temperature-sensitive magnetic member 114 comes into contact with the inner peripheral surface of the fixing belt 102. Hence, the heat of the temperature-sensitive magnetic member 114 is supplied to the fixing belt 102, and the fixing belt 102 is heated by the temperature-sensitive magnetic member 114.

Then, the control unit 50 functioning as a part of a fixing-member moving unit increases the number of rotations of the driving motor M that rotates the fixing belt 102 when a predetermined time elapses since the supply of the alternating current to the exciting coil 110 (see step S102) is started (step S104). Accordingly, the number of rotations of the fixing belt 102 increases and the number of sheets P available for fixing per unit time increases. In particular, the moving speed of the fixing belt 102 moving at a first speed becomes a second speed higher than the first speed, and hence the number of sheets P available for fixing per unit time increases. In this exemplary embodiment, driving speeds of respective mechanisms provided in the printer 10 increase in addition to the number of rotations of the driving motor M (the number of rotations of the fixing belt 102). Accordingly, productivity of the entire printer 10 increases.

In this exemplary embodiment, thermal conductivities of respective units are determined such that the temperature of the deformable member 260 becomes about 100° C. before the processing in step S104 is executed. When the processing in step S104 is performed, i.e., when the number of rotations of the fixing belt 102 increases, the temperature-sensitive magnetic member 114 is in contact with the fixing belt 102.

The number of rotations of the fixing belt 102 (the driving speeds of the respective mechanisms) are desirably increased after all sheets P during transportation in the printer 10 are output to the outside of the printer 10. If the number of rotations of the fixing belt 102 (the driving speeds of the respective mechanisms) are increased during transportation of a sheet P, the quality of an image formed on the sheet P may be degraded, or a paper jam of the sheet P may likely occur.

Then, the control unit 50 outputs a predetermined control signal to the power supply unit 95 (see FIG. 1) to additionally apply electric power to the exciting coil 110 (step S105). In particular, the control unit 50 functioning as a part of a power supply unit supplies higher electric power to the exciting coil 110 than the electric power supplied before the processing in step S105 is executed. Accordingly, the fixing belt 102 and the temperature-sensitive magnetic member 114 are further heated.

Also, the control unit 50 further increases the number of rotations of the driving motor M that rotates the fixing belt 102 (step S106). In particular, the moving speed of the fixing belt 102 that moves at the second speed is changed to a third speed higher than the second speed. In this case, the driving speeds of the respective mechanisms provided in the printer 10 are increased in addition to the number of rotations of the driving motor M. By executing this processing, the number of sheets P available for fixing per unit time further increases. When the processing in step S105 (additional application of electric power) is performed, since a certain time has elapsed after the power is turned on, there is an excess of electric power, which has been used for start-up of the other mechanisms. In the processing of step S105, such an excess of electric power is additionally applied to the exciting coil 110.

In the above description, the configuration in which the temperature-sensitive magnetic member 114 is separated from the fixing belt 102 when power is turned on has been described. However, a configuration in which the temperature-sensitive magnetic member 114 is normally in contact with the fixing belt 102 may be conceived. Even if the temperature-sensitive magnetic member 114 is normally in contact with the fixing belt 102, when a certain time elapses since power is turned on, heat is stored in the temperature-sensitive magnetic member 114. If heat is stored in the temperature-sensitive magnetic member 114, the temperature of the fixing belt 102 hardly decreases even when the fixing processing is continuously performed on plural sheets P. Productivity of the fixing processing increases.

If the temperature-sensitive magnetic member 114 is normally in contact with the fixing belt 102, immediately after power is turned on, heat of the fixing belt 102 that is gradually heated by the magnetic fields H is reduced by the temperature-sensitive magnetic member 114. In this case, a temperature rise of the temperature of the fixing belt 102 to the fixing set temperature takes a time, and the fixing processing is not started. Owing to this, in this exemplary embodiment, the temperature-sensitive magnetic member 114 is separated from the fixing belt 102 immediately after power is turned on. Accordingly, the temperature of the fixing belt 102 increases quickly, and a time required until the fixing processing becomes available for a first sheet P decreases.

In the configuration of this exemplary embodiment, the magnetic fields H generated by the exciting coil 110 act on the temperature-sensitive magnetic member 114 in addition to the fixing belt 102. In particular, energy input to the fixing device 100 is distributed to the fixing belt 102 and the temperature-sensitive magnetic member 114. Hence, the temperature of the fixing belt 102 increases slowly as compared with a configuration without the temperature-sensitive magnetic member 114 or a configuration in which, for example, the temperature-sensitive magnetic member 114 has slits (described later) and is hardly heated. As the result, in this exemplary embodiment, it is required to restrict the number of rotations of the fixing belt 102 (the number of sheets P available for fixing per unit time), as compared with the configuration without the temperature-sensitive magnetic member 114 or the other configuration. In particular, if the number of rotations of the fixing belt 102 is increased, since the temperature of the fixing belt 102 is not high, the temperature of the fixing belt 102 may become the fixing set temperature or lower at an early stage.

Meanwhile, if the fixing processing is continued while the number of rotations of the fixing belt 102 is restricted, productivity may decrease. Owing to this, in this exemplary embodiment, the number of rotations of the fixing belt 102 is increased when the temperature-sensitive magnetic member 114 comes into contact with the fixing belt 102 and starts heating the fixing belt 102 as described above. Also, in this exemplary embodiment, electric power is additionally applied as described above. Accordingly, in the fixing device 100 according to this exemplary embodiment, productivity is small immediately after power is turned on; however, decrease in productivity is generally restricted.

Although not described above, the deformable member 260 according to this exemplary embodiment is provided inside (at the inner side of) the cylindrical fixing belt 102 as shown in FIG. 7. Alternatively, for example, the deformable member 260 may be provided inside the long hole 251A formed in the first guide member 251 (see FIG. 7), or inside the long hole 252A formed in the second guide member 252. In particular, the deformable member 260 may be provided in a region outside (at the outer side of) the fixing belt 102. The temperature at the outside of the fixing belt 102 varies depending on the environment in which the printer 10 is installed. If the deformable member 260 is provided in the region outside the fixing belt 102, a timing at which the deformable member 260 is transformed may likely vary. Owing to this, in this exemplary embodiment, the deformable member 260 is provided inside the fixing belt 102.

Figure 9:
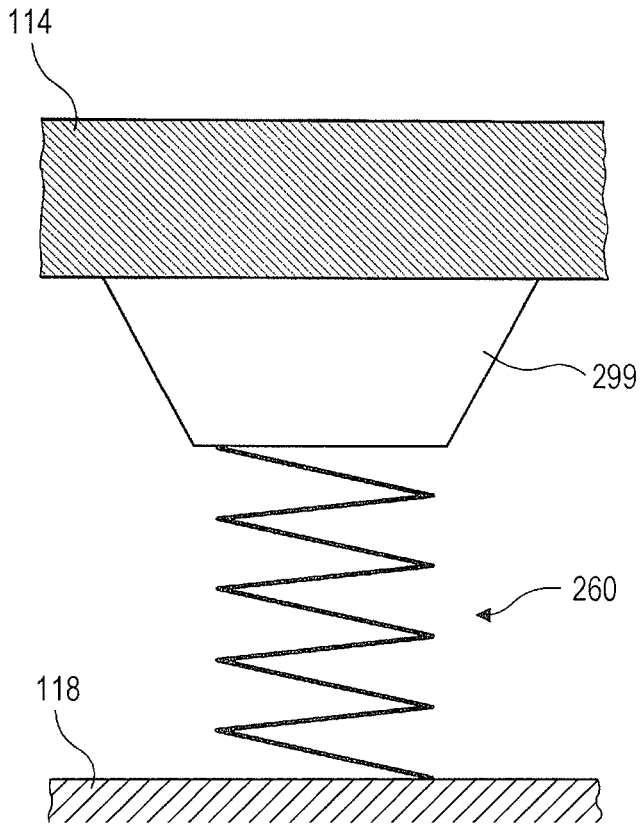
FIG. 9 is an illustration for explaining a structure around a deformable member.

In FIG. 7, the temperature-sensitive magnetic member 114 directly comes into contact with the deformable member 260. However, as show in FIG. 9 (an illustration for explaining a peripheral structure of the deformable member 260), a transferring member 299 that transfers the heat from the temperature-sensitive magnetic member 114 to the deformable member 260 may be provided between the temperature-sensitive magnetic member 114 and the deformable member 260. The transferring member 299 has a columnar shape and has an outer diameter that gradually decreases from the temperature-sensitive magnetic member 114 toward the deformable member 260.

Next, a function of the temperature-sensitive magnetic member 114 after the temperature-sensitive magnetic member 114 comes into contact with the fixing belt 102 will be described with reference to FIGS. 10A and 10B.

Figure 10B:
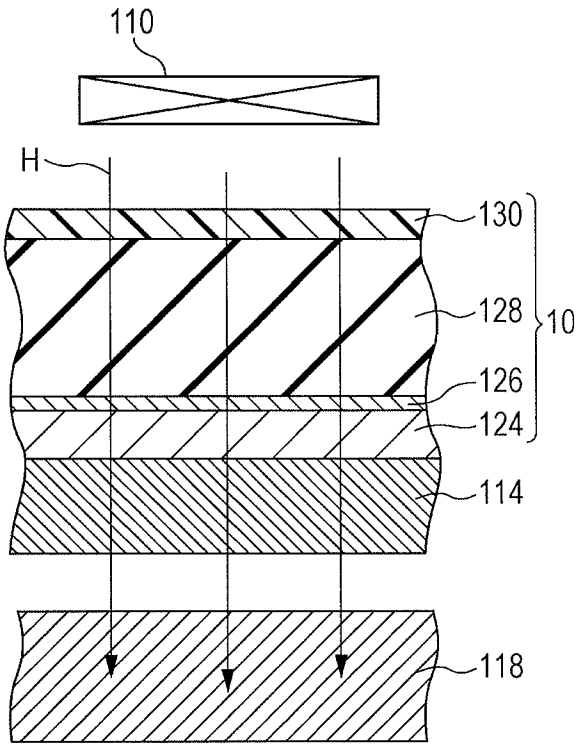
FIG. 10B is an illustration showing a state in which the temperature of the temperature-sensitive magnetic member is equal to or higher than the permeability-change start temperature.
Figure 10A:
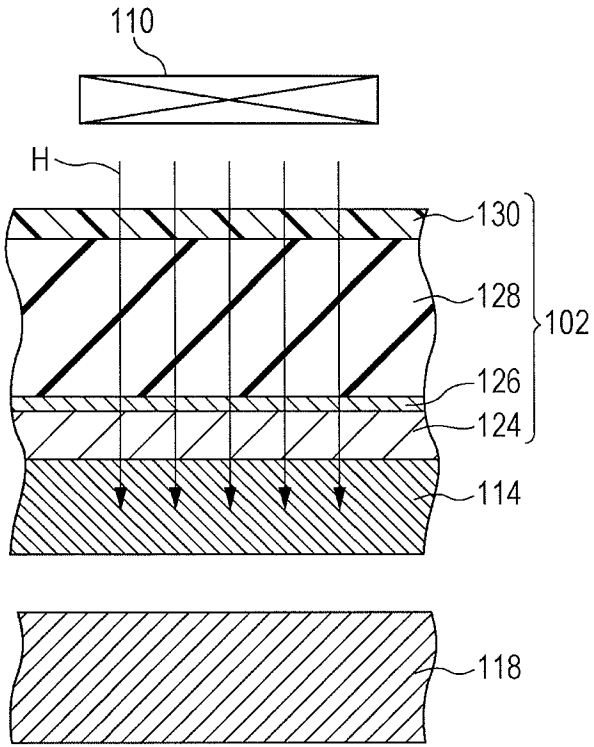
FIG. 10A is an illustration showing a state in which the temperature of the temperature-sensitive magnetic member is equal to or lower than a permeability-change start temperature.

FIG. 10A illustrates a state in which the temperature of the temperature-sensitive magnetic member 114 is equal to or lower than the permeability-change start temperature. FIG. 10B illustrates a state in which the temperature of the temperature-sensitive magnetic member 114 is equal to or higher than the permeability-change start temperature.

As shown in FIG. 10A, when the temperature of the temperature-sensitive magnetic member 114 is equal to or lower than the permeability-change start temperature (in a state shown in FIGS. 2 and 3), since the temperature-sensitive magnetic member 114 is a ferromagnetic member, a magnetic flux density increases. Also, the magnetic fields H penetrating through the fixing belt 102 enter the temperature-sensitive magnetic member 114, and form a closed magnetic circuit. The closed magnetic circuit enhances the magnetic fields H. Accordingly, a sufficient amount of heat of the heat-generating layer 126 in the fixing belt 102 is obtained, and the temperature of the fixing belt 102 increases to the predetermined fixing set temperature.

In contrast, as shown in FIGS. 4 and 10B, when the temperature of the temperature-sensitive magnetic member 114 is equal to or higher than the permeability-change start temperature, the permeability of the temperature-sensitive magnetic member 114 decreases. The magnetic fields H penetrating through the fixing belt 102 penetrate through the temperature-sensitive magnetic member 114 and are headed to the inductive member 118. At this time, the magnetic flux density decreases and the magnetic fields H become weak. The closed magnetic circuit is no longer formed. Further, the eddy current flows to the inductive member 118 more than the eddy current to the heat-generating layer 126 and the temperature-sensitive magnetic member 114. The amounts of heat generated by the heat-generating layer 126 and the temperature-sensitive magnetic member 114 decrease. Hence, the temperatures of the fixing belt 102 and the temperature-sensitive magnetic member 114 decrease.

Figure 11:
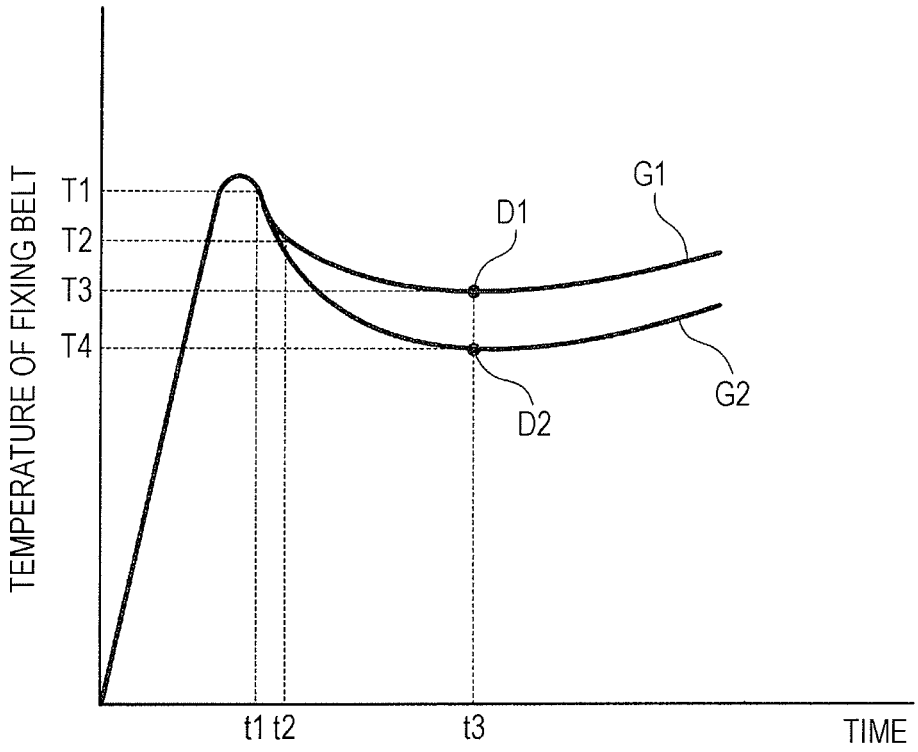
FIG. 11 is an illustration showing a change in temperature of the fixing belt when fixing processing is performed on plural sheets.

FIG. 11 is an illustration showing a change in temperature of the fixing belt 102 when the fixing processing is performed on plural sheets P.

A graph G1 in FIG. 11 is a time-temperature curve of the fixing device 100 according to this exemplary embodiment. A graph G2 is a time-temperature curve according to a comparative example. In particular, G2 is a time-temperature curve of the fixing device 100 when the temperature-sensitive magnetic member 114 does not come into contact with the fixing belt 102.

In the graph G1, the temperature of the fixing belt 102 increases until a time t1, and the pressure roller 104 comes into contact with the fixing belt 102 in a state in which the temperature is slightly overshot from a target fixing set temperature T1. By the contact of the pressure roller 104, the pressure roller 104 reduces the heat of the fixing belt 102. Hence the temperature of the fixing belt 102 decreases to the fixing set temperature T1. Then, fixing for a first sheet P is performed between the time t1 and a time t2. As the result, the first sheet P reduces the heat of the fixing belt 102, and the temperature of the fixing belt 102 decreases to a temperature T2.

Then, a second sheet P is supplied between the time t2 and a time t3. The second sheet P reduces the heat of the fixing belt 102. In this exemplary embodiment, almost when the second sheet P is supplied, the temperature-sensitive magnetic member 114, which is at a temperature higher than the temperature of the fixing belt 102, comes into contact with the fixing belt 102. In particular, thermal conductivities of respective units are determined such that the temperature of the deformable member 260 becomes about 100° C. almost when the second sheet P is supplied. When the second sheet P is supplied, the deformable member 260 starts expanding, and the temperature-sensitive magnetic member 114 comes into contact with the fixing belt 102.

Accordingly, the heat is supplied from the temperature-sensitive magnetic member 114 to the fixing belt 102. As the result, in this exemplary embodiment, the degree of decrease in temperature of the fixing belt 102 is small. Here, when it is assumed that a lowermost point of the temperature of the fixing belt 102 is a temperature droop (D), in the fixing device 100 according to this exemplary embodiment, the temperature decreases to a temperature droop D1 (temperature T3) at the time t3.

In contrast, in the fixing device 100 according to the comparative example, as described above, the temperature-sensitive magnetic member 114 does not come into contact with the fixing belt 102. Hence, the heat is not supplied from the temperature-sensitive magnetic member 114 to the fixing belt 102, and the temperature decreases to a temperature droop D2 (temperature T4 (<temperature T3)).

Figure 12:
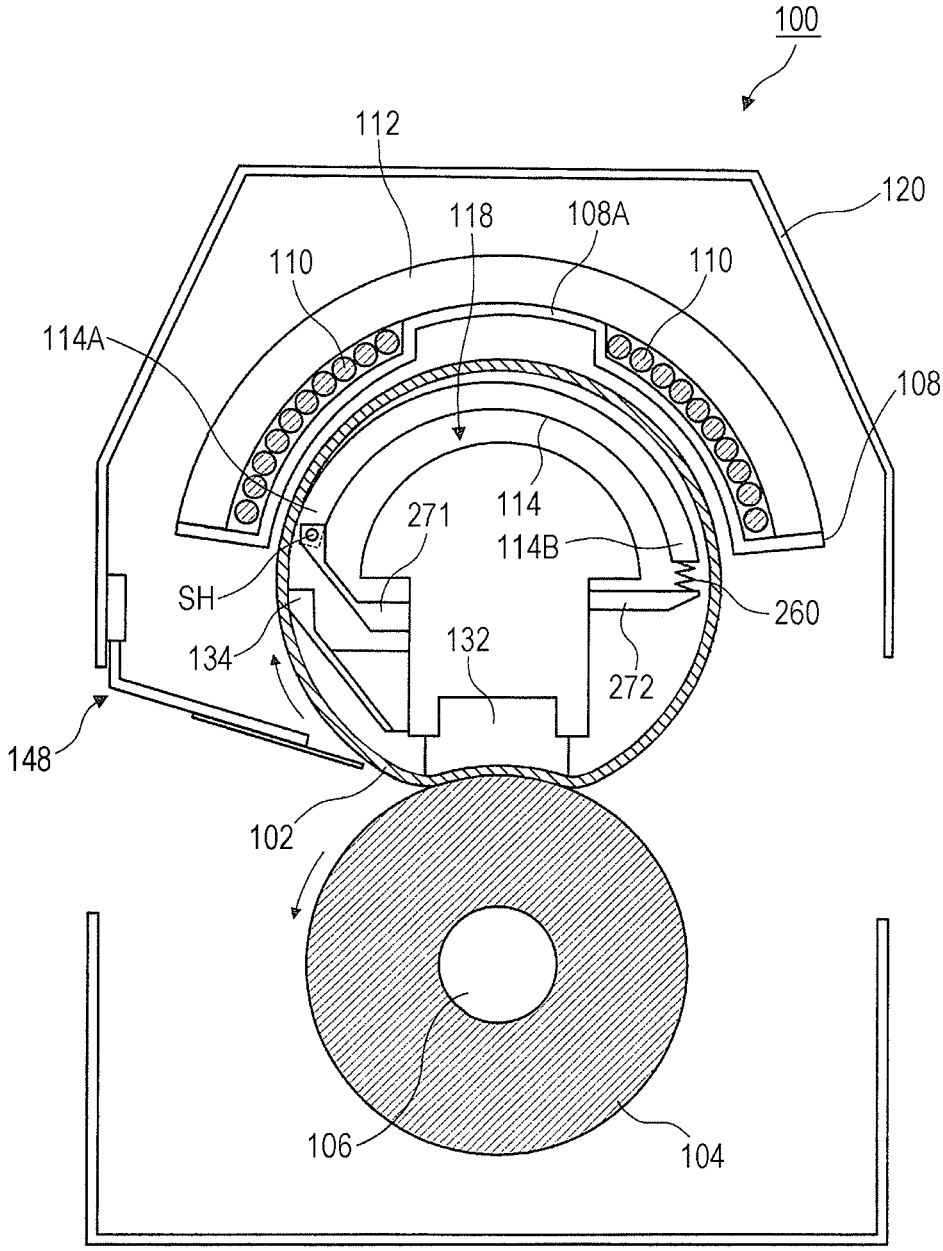
FIG. 12 is an illustration showing another exemplary embodiment of the fixing device.

FIG. 12 is an illustration showing another exemplary embodiment of the fixing device 100.

In the fixing device 100 shown in the figure, a shaft SH penetrates through a first end portion 114A (a first end portion located at the upstream side of the fixing belt 102 in the rotation direction) of the temperature-sensitive magnetic member 114. This temperature-sensitive magnetic member 114 is rotatable (swingable) around the first end portion 114A. The shaft SH is supported by a first support member 271 attached to a first side surface of the inductive member 118. Also in this exemplary embodiment, a second support member 272 is attached to a second side surface of the inductive member 118. The second support member 272 extends to a position below a second end portion 114B of the temperature-sensitive magnetic member 114. Also in this exemplary embodiment, a deformable member 260 is provided between the second end portion 114B of the temperature-sensitive magnetic member 114 and the second support member 272.

In this exemplary embodiment, when the deformable member 260 expands, the second end portion 114B of the temperature-sensitive magnetic member 114 moves upward in the figure. Accordingly, the temperature-sensitive magnetic member 114 is entirely displaced upward in the figure. By the displacement, the temperature-sensitive magnetic member 114 comes into contact with the inner peripheral surface of the fixing belt 102. With the configuration shown in FIG. 2, the deformable member 260 is arranged between the temperature-sensitive magnetic member 114 and the inductive member 118. Thus, the distance between the temperature-sensitive magnetic member 114 and the inductive member 118 becomes large. In this case, the size of the fixing device 100 may become large. With the configuration shown in FIG. 12, the distance between the temperature-sensitive magnetic member 114 and the inductive member 118 may be reduced, and hence the size of the fixing device 100 may be reduced.

Figures 13A, 13B, 13C:
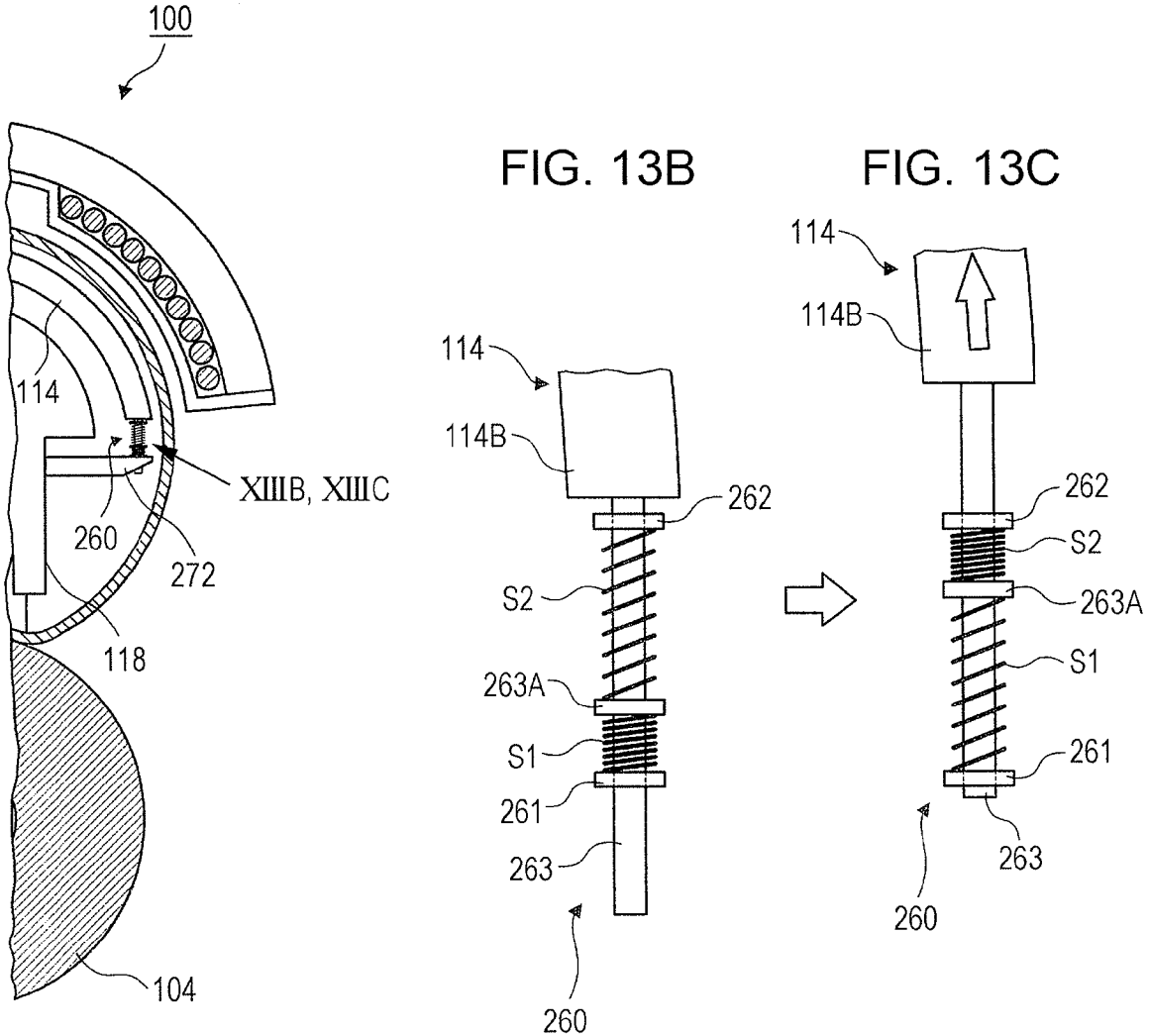
FIGS. 13A to 13C are illustrations showing another configuration example of the deformable member.

FIGS. 13A to 13C are illustrations showing another configuration example of the deformable member 260. FIG. 13B is an enlarged view of a portion indicated by arrow XIIIB in FIG. 13A. FIG. 13C is an enlarged view of a portion indicated by arrow XIIIC in FIG. 13A.

A deformable member 260 shown in FIGS. 13A to 13C is formed of plural components. In particular, as shown in FIG. 13B, the deformable member 260 is in contact with the second end portion 114B of the temperature-sensitive magnetic member 114, and includes a shaft-like advance/retract member 263 that is able to advance to and retract from the second end portion 114B. A protrusion 263A is provided at a center portion of the advance/retract member 263 in the longitudinal direction. The protrusion 263A protrudes in a radial direction of the advance/retract member 263.

The deformable member 260 according to this exemplary embodiment is provided with a first support member 261 that supports the advance/retract member 263 in a state in which the advance/retract member 263 is able to advance and retract. A second support member 262 is provided at a position closer to the temperature-sensitive magnetic member 114 as compared with the first support member 261. The second support member 262 supports the advance/retract member 263. A first coil spring S1 is provided between the protrusion 263A and the first support member 261. A second coil spring S2 is provided between the protrusion 263A and the second support member 262. The first coil spring S1 is formed of a shape memory alloy. Similarly to the above-mentioned shape memory alloy, the shape memory alloy expands when the temperature thereof is at a predetermined temperature (for example, 100° C.), and the shape memory alloy contracts when the temperature thereof is lower than this temperature.

With the configuration shown in FIGS. 13A to 13C, the heat is transferred from the heated temperature-sensitive magnetic member 114 to the first coil spring S1, and when the temperature of the first coil spring S1 exceeds the predetermined temperature, the first coil spring S1 expands. When the first coil spring S1 expands, the protrusion 263A in FIG. 13B is pushed upward in the figure by the first coil spring S1. Accordingly, as shown in FIG. 13C, the advance/retract member 263 is displaced upward in the figure. By the displacement, the temperature-sensitive magnetic member 114 is pressed to the fixing belt 102.

The first coil spring S1 contracts when the temperature of the temperature-sensitive magnetic member 114 decreases. With the configuration according to this exemplary embodiment, since the second coil spring S2 that causes a compression force to act on the first coil spring S1 is provided, the first coil spring S1 contracts more quickly. In a situation in which the first coil spring S1 hardly contracts (if the first coil spring S1 takes a time for contraction), the fixing belt 102 is likely heated while the temperature-sensitive magnetic member 114 is in contact with the fixing belt 102. In this case, the heat of the fixing belt 102 is released to the temperature-sensitive magnetic member 114, and heating efficiency of the fixing belt 102 may be degraded.

As shown in FIGS. 13A to 13C, if the second coil spring S2 is provided, the first coil spring S1 may be formed of a shape memory alloy that is treated with one-way shape memory processing, so that the first coil spring S1 expands when the temperature increases but does not contract when the temperature decreases. When the first coil spring S1 formed of the shape memory alloy treated with the one-way shape memory processing is merely arranged, the first coil spring S1 continuously expands and does not contract even if the temperature decreases, possibly resulting in that the temperature-sensitive magnetic member 114 is continuously in contact with the fixing belt 102. If the second coil spring S2 is provided, the first coil spring S1 is compressed by the second coil spring S2. Even if the first coil spring S1 formed of the shape memory alloy treated with the one-way form memory processing is used, the temperature-sensitive magnetic member 114 is separated from the fixing belt 102.

Figure 14:
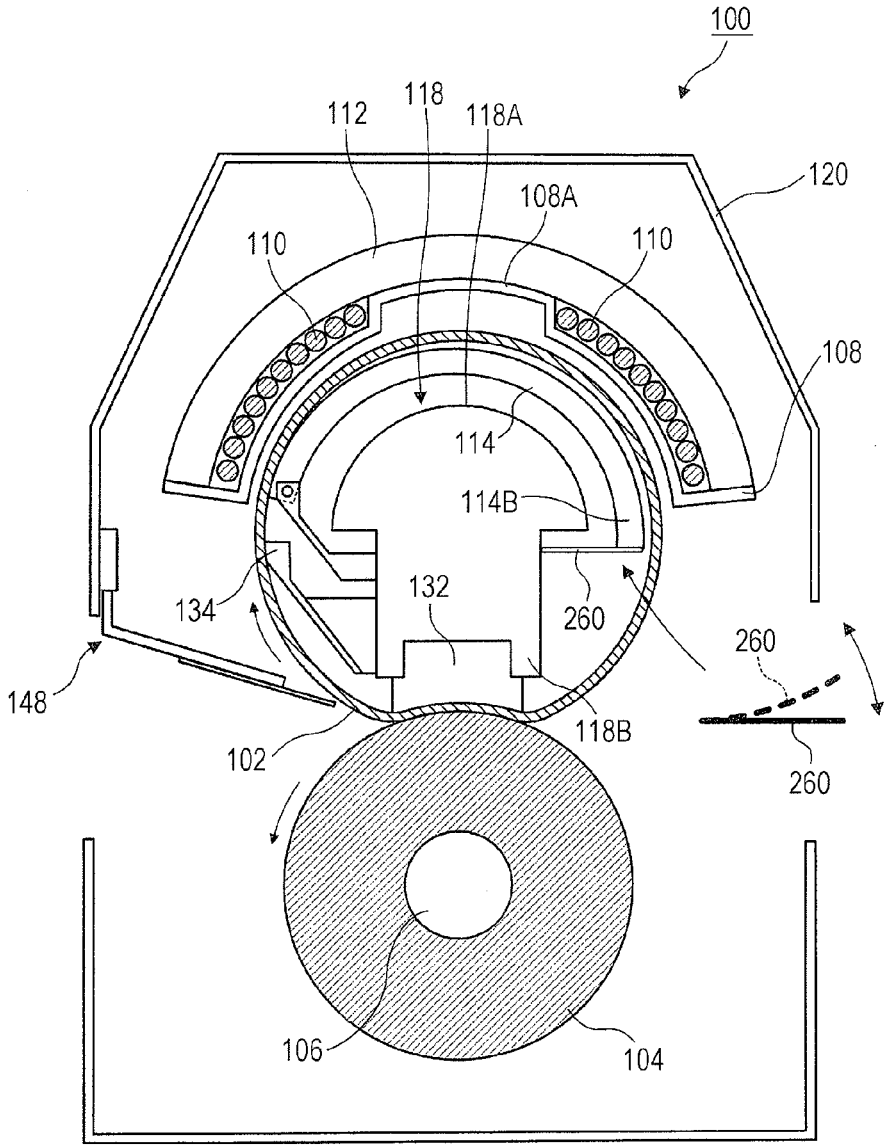
FIG. 14 is an illustration showing another configuration example of the deformable member.

FIG. 14 is an illustration showing another configuration example of the deformable member 260.

In the above description, the deformable member 260 has a coil-spring-like shape. Alternatively, the deformable member 260 may have a plate-like shape as shown in the figure. A plate-like deformable member 260 is provided such that a first end thereof is fixed to the side surface of the inductive member 118, the deformable member 260 expands from this side surface toward the second end portion 114B of the temperature-sensitive magnetic member 114, and a second end thereof is fixed to the second end portion 114B.

The deformable member 260 in FIG. 14 uses a shape memory alloy treated with two-way shape memory processing. When the temperature of the deformable member 260 exceeds a predetermined temperature (for example, 100° C.), the deformable member 260 is bent toward the temperature-sensitive magnetic member 114. In this exemplary embodiment, because of bending (curve) of the temperature-sensitive magnetic member 114, an end portion of the deformable member 260 is displaced upward in the figure. Because of the displaceable end portion, the temperature-sensitive magnetic member 114 moves upward in the figure. Hence, the temperature-sensitive magnetic member 114 comes into contact with the inner peripheral surface of the fixing belt 102.

When the temperature of the deformable member 260 decreases, the deformable member 260 is transformed from the bent state to the flat state. Accordingly, the temperature-sensitive magnetic member 114 is separated from the fixing belt 102. With the configuration in this exemplary embodiment, the deformable member 260 may be arranged along a direction (horizontal direction) intersecting with (orthogonal to) a direction (up-down direction) in which the temperature-sensitive magnetic member 114 is moved. The degree of freedom for arrangement of the deformable member 260 increases. In particular, an arrangement form other than the arrangement form in FIG. 2 and other figures may be employed. Thus, the degree of freedom for arrangement of the deformable member 260 increases.

The fixing device 100 provided in the printer 10 has been described above. Alternatively, the above-described configuration may be applied to a heating device that heats a heated body.

Figure 15A:
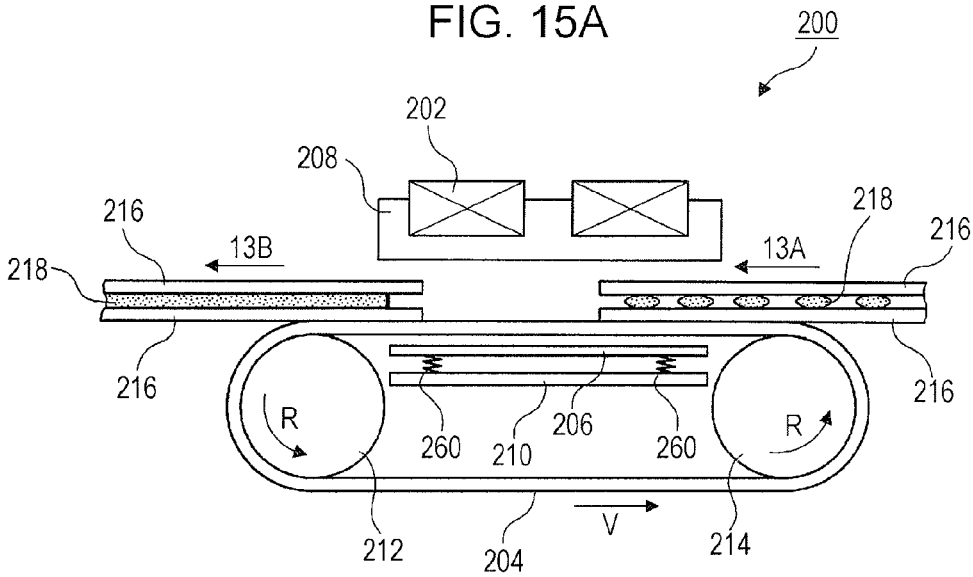
FIGS. 15A and 15B are illustrations for explaining a heating device.
Figure 15B:
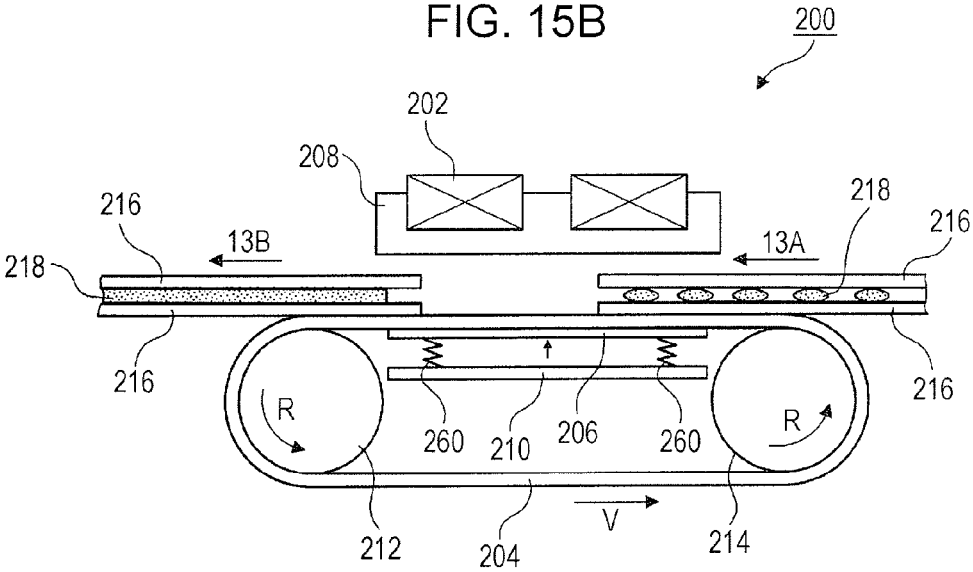

FIGS. 15A and 15B are illustrations for explaining a heating device. Like reference signs refer like members having functions equivalent to those of the above-described exemplary embodiment, and redundant description will be omitted.

As shown in FIG. 15A, a heating device 200 includes exciting coils 202 that generate magnetic fields, and a heating belt 204 that is arranged to face the exciting coils 202 and is formed of a material and a layer configuration similar to those of the fixing belt 102. The heating device 200 includes a temperature-sensitive magnetic member 206 that is configured similarly to the above-described temperature-sensitive magnetic member 114. The temperature-sensitive magnetic member 206 is arranged inside the heating belt 204, at a position separated from the heating belt 204. The heating device 200 further includes a temperature sensor (not shown) that is in contact with an inner peripheral surface of the heating belt 204 and detects the temperature of the heating belt 204.

The exciting coils 202 are supported by a bobbin 208 made of resin. Also, the heating belt 204 is supported by a pair of rotatable rollers 212 and 214. The rollers 212 and 214 each have a core bar formed of non-magnetic SUS, and an elastic layer around the core bar. One of the rollers 212 and 214 is connected with a driving mechanism, such as a gear and a motor. In this exemplary embodiment, the rollers 212 and 214 are rotated by the driving mechanism in a direction indicated by arrow R. Hence, the heating belt 204 moves in a direction indicated by arrow V.

The temperature-sensitive magnetic member 206 according to this exemplary embodiment has a flat-plate-like shape. An inductive member 210 is provided at the inner side with respect to the temperature-sensitive magnetic member 206. The inductive member 210 has a flat-plate-like shape and is formed of the same material as that of the inductive member 118. The inductive member 210 may have a thickness larger than the skin depth. In this example, aluminum with a thickness of 1 mm is used for the inductive member 210. In the heating device 200, like the above-described configuration, deformable members 260 are provided between the temperature-sensitive magnetic member 206 and the inductive member 210. A control unit similar to the above-described control unit 50 (see FIG. 1) performs operation control for respective units in the heating device 200.

An operation of the heating device 200 will be described. Described hereinafter is a case in which the heating device 200 is used for fusion bonding.

An energizing unit (not shown) energizes the exciting coil 202, and a magnetic field is generated around the exciting coil 202. The heating belt 204 generates heat by an electromagnetic induction effect due to the magnetic field, like the above-described fixing belt 102. A heat-generating layer of the temperature-sensitive magnetic member 206 generates heat by an electromagnetic induction effect due to the magnetic field. The temperature-sensitive magnetic member 206 is arranged with a gap with respect to the heating belt 204. Hence, the heat of the heating belt 204 is hardly transferred to the temperature-sensitive magnetic member 206. Accordingly, the temperature of the heating belt 204 increases in a short time.

Then, in the heating device 200, the rollers 212 and 214 rotate, and the heating belt 204 starts moving in the direction indicated by arrow V. A pair of resin plates 216 are transported to the heating device 200 (see arrow 13A). A solid adhesive 218 is interposed between the pair of plates 216. The adhesive 218 melts at a predetermined temperature. Then, heat is supplied from the heating belt 204, which is an example of a supply member, to the plates 216 and the adhesive 218. The adhesive 218 melts and spreads between the pair of plates 216. Then, the plates 216 are output from the heating device 200 by the movement of the heating belt 204 (see arrow 13B). The pair of plates 216 output from the heating device 200 are bonded together because the melting and spreading adhesive 218 is cooled and hardened.

Similarly to the above-described situation, when the plates 216 are transported, the temperature of the heating belt 204 decreases. Meanwhile, the temperature-sensitive magnetic member 206 is heated, and the temperature of the deformable members 260 increases because of the heat from the temperature-sensitive magnetic member 206. When the temperature of the deformable members 260 becomes a predetermined temperature, as shown in FIG. 15B, the deformable members 260 expand and push up the temperature-sensitive magnetic member 206. Accordingly, the temperature-sensitive magnetic member 206 comes into contact with the inner peripheral surface of the heating belt 204, and the heat is supplied from the temperature-sensitive magnetic member 206 to the heating belt 204. Accordingly, the heating belt 204 is heated. Then, the number of rotations of the rollers 212 and 214 is increased, so that the moving speed of the heating belt 204 is increased. Also, electric power is additionally applied to the exciting coil 202 and the number of rotations of the rollers 212 and 214 is further increased, so that the moving speed of the heating belt 204 is further increased.

Figure 16:
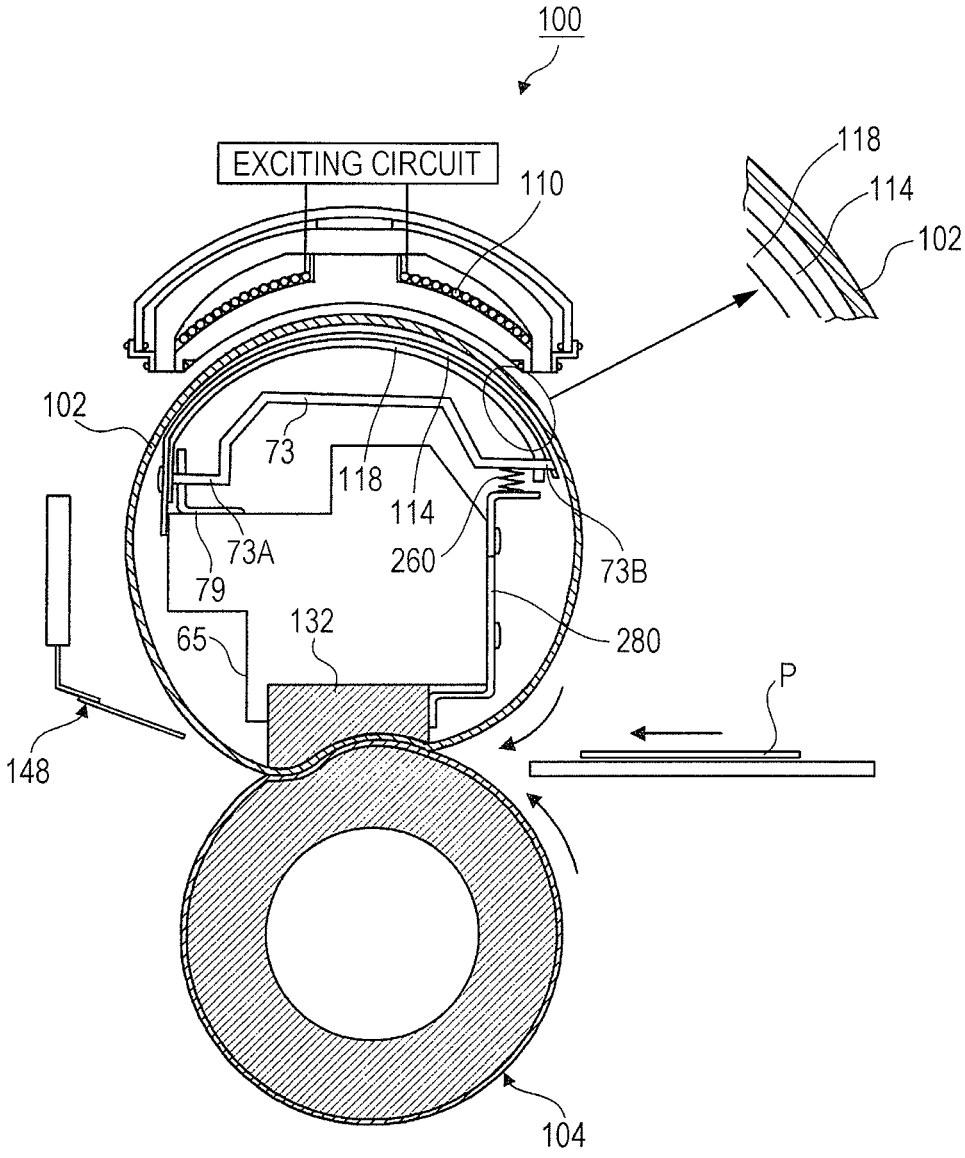
FIG. 16 is an illustration showing another exemplary embodiment of the fixing device.

Also, the fixing device 100 may be formed as shown in FIG. 16.

FIG. 16 is an illustration showing another exemplary embodiment of the fixing device 100.

A fixing device 100 shown in FIG. 16 includes a frame 65 inside a fixing belt 102, and an inductive member 118 with a curve that is attached to the frame 65, that has a plate-like shape, and that extends along an inner peripheral surface of the fixing belt 102. With the configuration in the figure, the inductive member 118 has a plate-like shape, and hence the fixing device 100 in the figure has a smaller weight than the fixing device 100 shown in FIG. 2 and other figures. The frame 65 is formed by combining plural metal sheets (not shown). The weight of the frame 65 is reduced as compared with a case in which a portion corresponding to the frame 65 is formed of a solid metal material.

The thickness of the inductive member 118 may be equal to or larger than the skin depth such that, even if the temperature-sensitive magnetic member 114 becomes non-magnetic and a magnetic flux penetrates through the temperature-sensitive magnetic member 114, the magnetic flux hardly penetrates through the inductive member 118. In this exemplary embodiment, an aluminum member with a thickness of 1 mm is used. In this exemplary embodiment, like the above-described configuration, a temperature-sensitive magnetic member 114 is provided between the inductive member 118 and the fixing belt 102. Further, in this exemplary embodiment, a magnetic-path shielding member 73 is provided at the inner side with respect to the inductive member 118. The magnetic-path shielding member 73 prevents magnetic force lines from leaking to the frame 65.

In this exemplary embodiment, a first end portion of the inductive member 118 and a first end portion of the temperature-sensitive magnetic member 114 are fixed to a first end 73A of the magnetic-path shielding member 73. Also, a second end portion of the inductive member 118 and a second end portion of the temperature-sensitive magnetic member 114 are fixed to a second end 73B of the magnetic-path shielding member 73. In this exemplary embodiment, a bent metal sheet 280 is fixed to a right side surface of the frame 65. Also, a deformable member 260 is provided between the metal sheet 280 and the second end 73B of the magnetic-path shielding member 73.

Further, in this exemplary embodiment, a support member 79 that supports the first end 73A of the magnetic-path shielding member 73 is provided. The magnetic-path shielding member 73 is swingable around the first end 73A. In the fixing device 100 shown in FIG. 16, the deformable member 260 expands by an increase in temperature of the temperature-sensitive magnetic member 114. With the expansion, the temperature-sensitive magnetic member 114 is pressed to the fixing belt 102. Accordingly, heat is supplied from the temperature-sensitive magnetic member 114 to the fixing belt 102, the heat of which has been reduced by a sheet P.

The case in which a solid developer is used has been described above as an example. Alternatively, a liquid developer may be used. The temperature of the fixing belt 102 may be detected by using a thermocouple instead of the thermistor 134. The thermistor 134 does not have to be provided at the inner periphery of the fixing belt 102, and may be provided at the outer periphery of the fixing belt 102. Further, the above-described temperature-sensitive magnetic member 114 may be formed of a material of only one type of temperature-sensitive layer through which eddy current easily flows. The above-described heating device 200 has been used for fusion bonding; however, the heating device 200 may be used as a drier.

In the above description, the deformable member 260 is formed of a shape memory alloy. However, a member formed by bonding two metal sheets with different thermal expansion coefficients together, i.e., so-called bimetal may be used as the deformable member 260. In the above description, the temperature-sensitive magnetic member 114 is moved by using the deformable member 260. However, the temperature-sensitive magnetic member 114 may be moved by using a cam and a motor, or by using a solenoid. In the above description, the number of rotations of the fixing belt 102 is increased after the temperature-sensitive magnetic member 114 comes into contact with the fixing belt 102. However, for example, the number of rotations of the fixing belt 102 may be increased and then the temperature-sensitive magnetic member 114 may be brought into contact with the fixing belt 102.

Before the deformable member 260 expands (before heating of the fixing belt 102 is completed), the fixing belt 102 is desirably separated from the temperature-sensitive magnetic member 114. However, as shown in FIG. 2 and other figures, part of the temperature-sensitive magnetic member 114 may be brought into contact with the inner peripheral surface of the fixing belt 102. In FIG. 2, a first end portion of the temperature-sensitive magnetic member 114 located at the upstream side of the fixing belt 102 in the rotation direction and a second end portion of the temperature-sensitive magnetic member 114 located at the downstream side of the fixing belt 102 in the rotation direction are in contact with the inner peripheral surface of the fixing belt 102.

In FIG. 12 and other figures, the first end portion of the temperature-sensitive magnetic member 114 is displaced by using the deformable member 260. Alternatively, deformable members 260 may be provided to face the first end portion and the second end portion of the temperature-sensitive magnetic member 114, and both end portions of the temperature-sensitive magnetic member 114 may be displaced. In FIG. 2, the temperature-sensitive magnetic member 114 is brought into contact with the inner peripheral surface of the fixing belt 102 by using the expansion of the deformable member 260. Alternatively, the temperature-sensitive magnetic member 114 may be brought into contact with the fixing belt 102 when the deformable member 260 contracts.

In the above description, the temperature-sensitive magnetic member 114 is heated. Alternatively, if a slit or the like is formed in the temperature-sensitive magnetic member 114, the temperature-sensitive magnetic member 114 is not heated (or is hardly heated). In this case, energy used for heating the temperature-sensitive magnetic member 114 acts on the fixing belt 102. In particular, energy used for heating the temperature-sensitive magnetic member 114 is distributed to the fixing belt 102. Heating efficiency of the fixing belt 102 increases.

Figure 17:
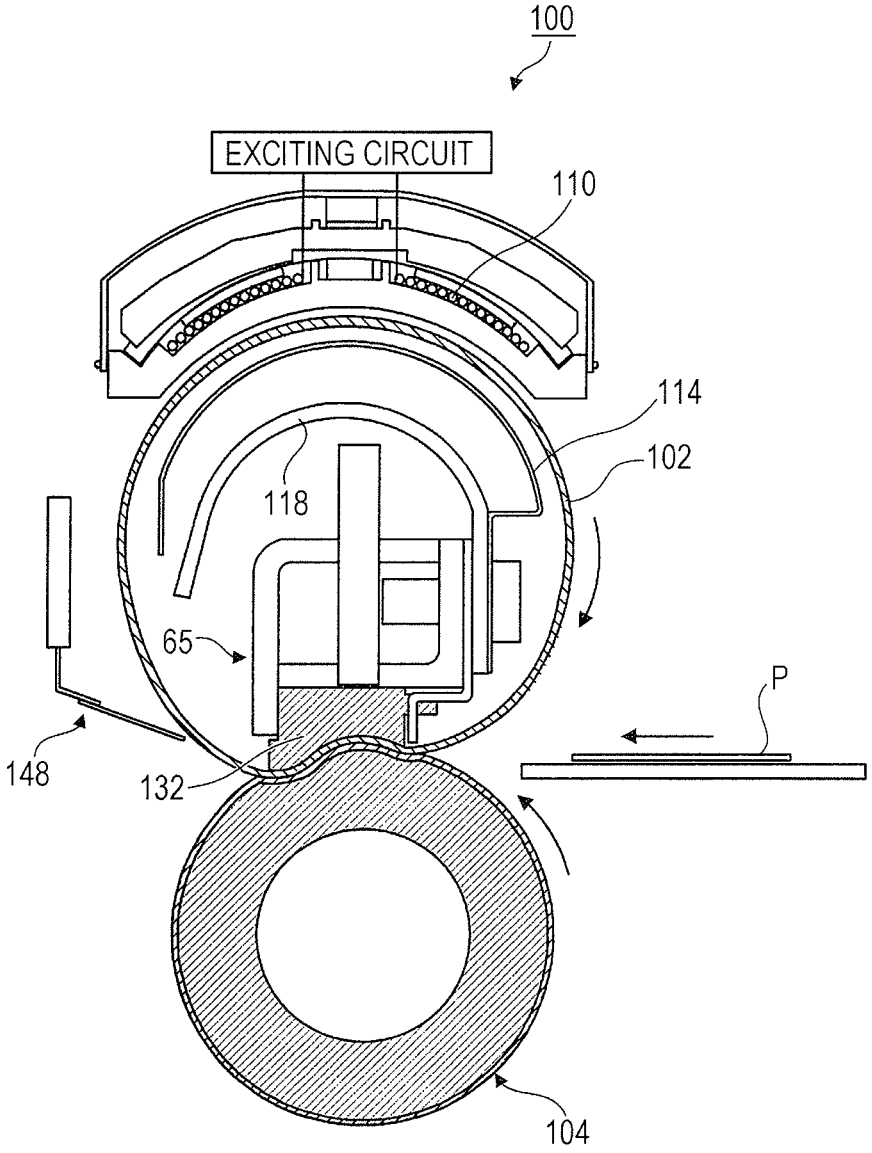
FIG. 17 is an illustration showing a fixing device in which a temperature-sensitive magnetic member is not heated.

FIG. 17 is an illustration showing a fixing device 100 in which a temperature-sensitive magnetic member 114 is not heated. In the fixing device 100, a slit (described later) is formed in the temperature-sensitive magnetic member 114 to prevent the temperature-sensitive magnetic member 114 from being heated. Also, to prevent the heat of the fixing belt 102 from being reduced by the temperature-sensitive magnetic member 114, the temperature-sensitive magnetic member 114 is separated from the fixing belt 102. In the fixing device 100 shown in FIG. 17, an inductive member 118 has a plate-like shape and is curved like the fixing device 100 shown in FIG. 16. Also, in the fixing device 100 shown in FIG. 17, a frame 65 is formed by combining plural metal sheets.

Figure 19A:
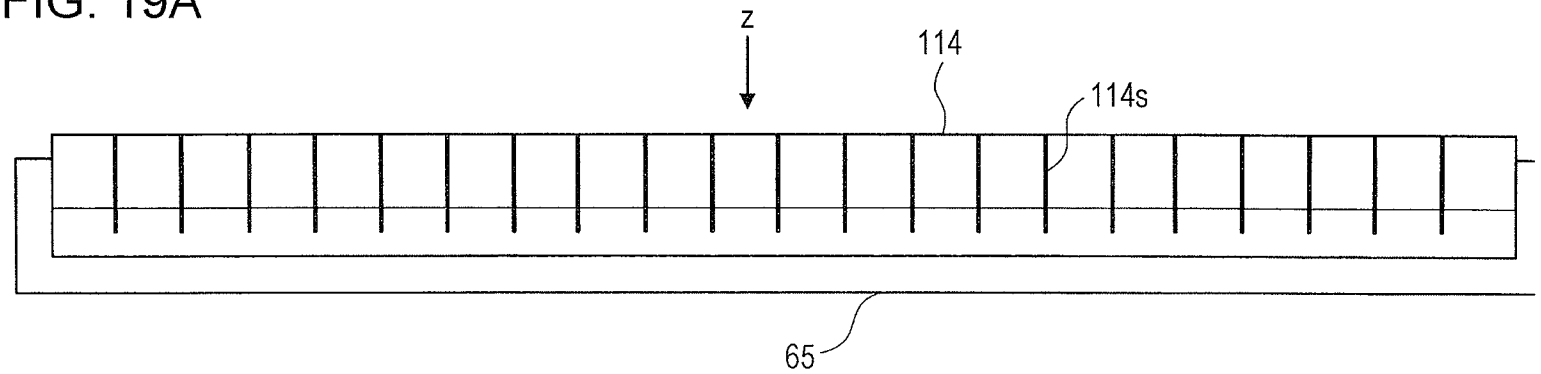
FIGS. 19A and 19B are illustrations showing slits formed in the temperature-sensitive magnetic member.
Figure 19B:
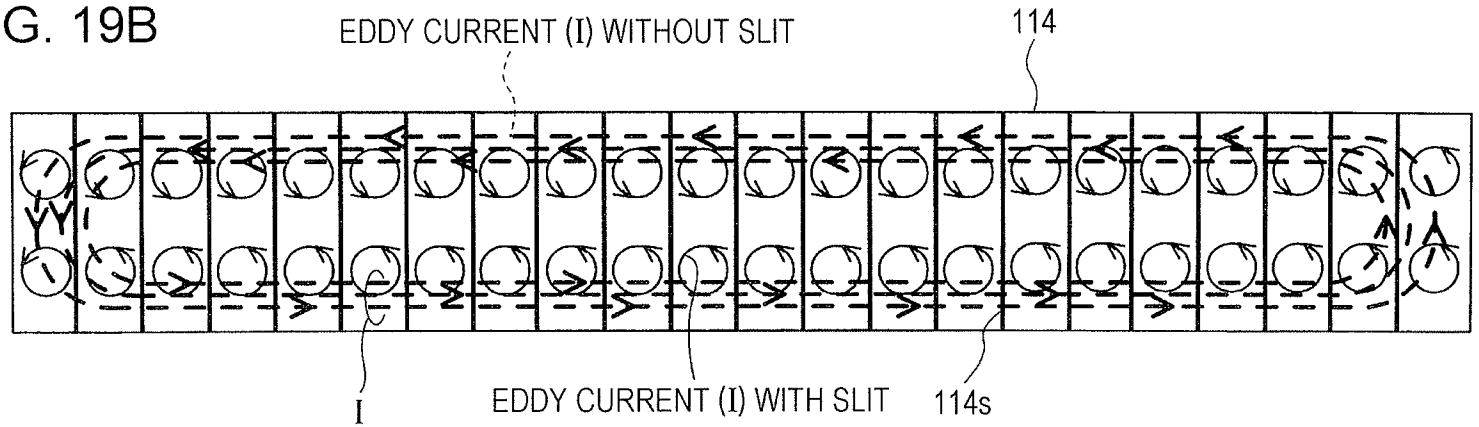

If the temperature-sensitive magnetic member 114 is not heated, as described above, energy used for heating the temperature-sensitive magnetic member 114 acts on the fixing belt 102, and hence the temperature of the fixing belt 102 quickly increases. In this case, a time required until fixing processing for a first sheet P is able to be started is shortened. To be more specific, in the fixing device 100 shown in FIG. 17, as shown in FIG. 18 (an illustration for explaining heat-generation ratio etc. between the fixing belt 102 and the temperature-sensitive magnetic member 114), a heat-generation ratio between the fixing belt 102 and the temperature-sensitive magnetic member 114 may be about 10:0. In this state, fixing processing may be performed, for example, in three seconds (as shown in FIGS. 19A and 19B, although the heat amount of the temperature-sensitive magnetic member 114 is not physically reduced to zero, eddy current generated at the temperature-sensitive magnetic member is restricted to attain the heat-generation ratio of about 10:0.

With this configuration, when plural sheets P are continuously transported, the heat of the fixing belt 102 is gradually reduced, and the temperature of the fixing belt 102 decreases. If the temperature of the fixing belt 102 becomes a certain temperature or lower, fixing may become difficult. The fixing processing is temporarily stopped, and has to wait until the temperature of the fixing belt 102 is recovered. As the result, with the configuration in which the temperature-sensitive magnetic member 114 is not heated and does not come into contact with the fixing belt 102, a time required until fixing for a first sheet P is able to be started is shortened; however, it is difficult to continuously perform fixing processing for plural sheets P.

In contrast, with the fixing device 100 in FIG. 2 and other figures in which the temperature-sensitive magnetic member 114 is heated and brought into contact with the fixing belt 102, as described above, the temperature-sensitive magnetic member 114 at a higher temperature than the temperature of the fixing belt 102 may be brought into contact with the fixing belt 102 during the fixing processing. Accordingly, the heat is supplied to the fixing belt 102, the temperature of which has been reduced. Even when plural sheets P are continuously transported, the fixing processing may be performed for the sheets P.

Also, with the fixing device 100 shown in FIG. 17, it is difficult to perform the fixing processing at a high speed because the temperature of the fixing belt 102 may decrease. However, with the fixing device 100 shown in FIG. 2 and other figures, the heat is supplied in the mid course. The fixing processing may be performed at a high speed. Further, with the fixing device 100 shown in FIG. 2 and other figures, the time until fixing becomes available is longer than the time of the fixing device 100 shown in FIG. 17 (as shown in FIG. 18, for example, 4 to 6 seconds). After the fixing processing is started, productivity may be increased, and productivity as a whole process may be increased as compared with the fixing device 100 shown in FIG. 17. In the fixing device 100 shown in FIG. 2 and other figures, as shown in FIG. 18, the fixing belt 102 and the temperature-sensitive magnetic member 114 are heated by a ratio of, for example, (7 to 8):(2 to 3). As described above, in the fixing device 100 according to this exemplary embodiment, the time required until the fixing becomes available is longer than the time of the fixing device 100 illustrated in FIG. 17. As compared with a typical fixing device of related art, the time required until the fixing becomes available is very short. Therefore, with the fixing device 100 according to this exemplary embodiment, the fixing is performed at a high speed and with a high productivity, and when the fixing is performed for plural sheets P, fixed images are provided without making a user wait.

Now, the slit formed in the temperature-sensitive magnetic member 114 is described with reference to FIGS. 19A and 19B.

FIGS. 19A and 19B are illustrations showing slits formed in the temperature-sensitive magnetic member 114. FIG. 19A is a side view when the temperature-sensitive magnetic member 114 is mounted on the frame 65. FIG. 19B is a plan view from the upper side (in z direction) of FIG. 19A. Plural slits 114*s* are formed in the temperature-sensitive magnetic member 114 shown in FIGS. 19A and 19B. The slits 114*s* are orthogonal to a direction in which eddy current I generated by magnetic fields H flows. When the slits 114*s* are formed, the eddy current I, which flows in a form of large eddy along the longitudinal direction of the temperature-sensitive magnetic member 114 if the slit 114*s* is not formed (see broken lines in FIG. 19B), is divided by the slits 114*s*.

In this case, the eddy current I flows through the temperature-sensitive magnetic member 114 in a form of small eddies each of which is arranged in a region between the slits 114*s* (see solid lines in FIG. 19B). The total amount of eddy current I is reduced. Consequently, the heat amount (Joule heat W) of the heat generated by the temperature-sensitive magnetic member 114 decreases, and heat is hardly generated. The temperature-sensitive magnetic member 114 exemplarily shown in FIGS. 19A and 19B has the slits 114*s* in the direction orthogonal to the direction in which the eddy current I flows. As long as the flow of the eddy current I is divided, slits inclined to the direction in which the eddy current I flows may be formed. Also, the slits 114*s* do not have to be formed in the entire region in the width direction of the temperature-sensitive magnetic member 114, and may be formed at part in the width direction of the temperature-sensitive magnetic member 114. For example, the number, positions, and inclination angles of the slits may be determined in accordance with the heat amount of the temperature-sensitive magnetic member 114.

In the fixing device 100 described above, the fixing belt 102 is directly heated through heating by electromagnetic induction. Also, the temperature-sensitive magnetic member 114 is directly heated through heating by electromagnetic induction. The heated temperature-sensitive magnetic member 114 is brought into contact with the inner peripheral surface of the fixing belt 102. In particular, in the above-described exemplary embodiment, a heating subject is directly heated through heating by electromagnetic induction. The fixing belt 102 does not have to be directly heated as described above, and may be indirectly heated through heat transfer. Also, a heat supply member, such as the temperature-sensitive magnetic member 114, which comes into contact with the fixing belt 102 and supplies heat to the fixing belt 102, does not have to be directly heated, and may be indirectly heated.

The fixing belt 102, and the heat supply member that supplies heat to the fixing belt 102 will be described below in detail according to an exemplary embodiment of heating without using heating through electromagnetic induction.

Figure 20B:
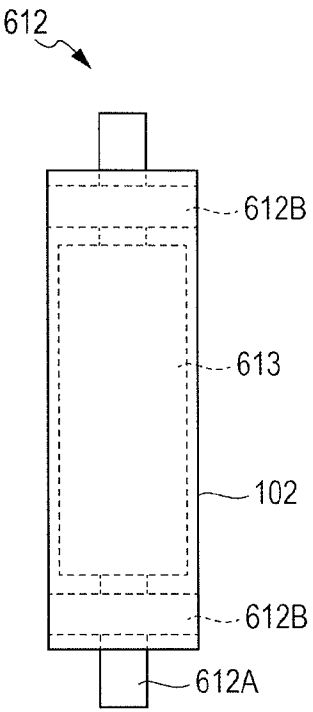
FIGS. 20A and 20B are illustrations showing another exemplary embodiment of the fixing device.
Figure 20A:
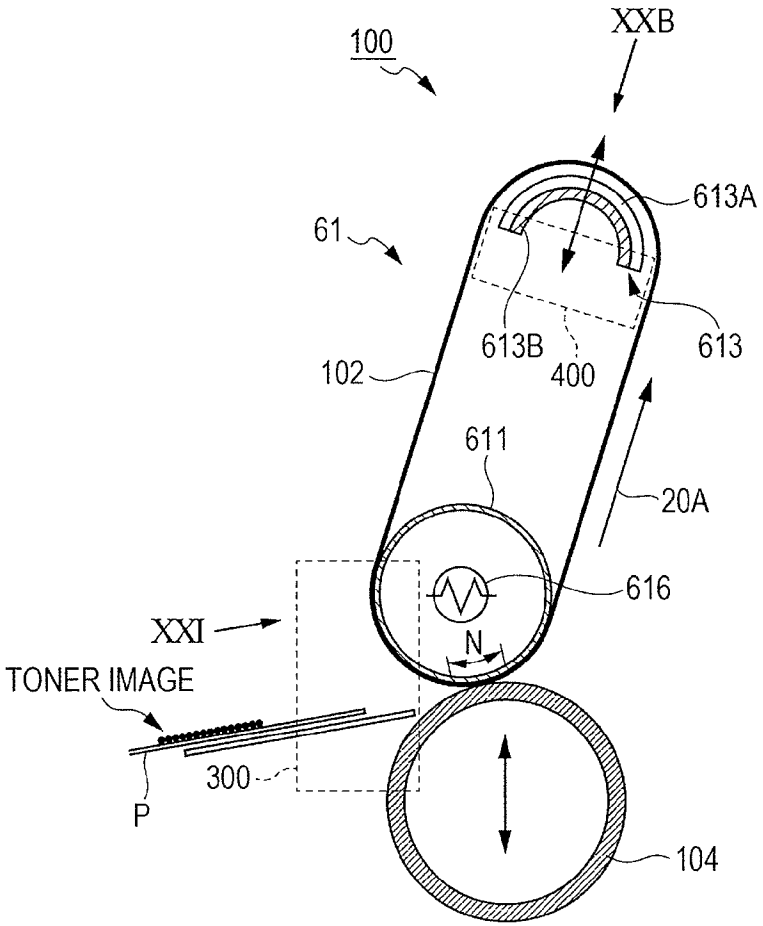

FIGS. 20A and 20B are illustrations showing another exemplary embodiment of the fixing device 100. FIG. 20B is an illustration when an upper section of the fixing device 100 in FIG. 20A is viewed in a direction indicated by arrow XXB.

As shown in FIG. 20A, the fixing device 100 according to this exemplary embodiment includes a fixing belt module 61 having a fixing belt 102, a pressure roller 104 arranged at and pressed to the fixing belt module 61, and a transmission mechanism 300 that transmits a rotational driving force from the pressure roller 104 to the fixing belt module 61. The fixing device 100 also has a nip part N at which a toner image is fixed to a sheet P by pressing and heating the sheet P is provided between the fixing belt module 61 and the pressure roller 104.

The fixing belt module 61 includes a fixing belt 102 and a fixing roller 611 that is arranged inside the fixing belt 102. The pressure roller 104 is pressed to the fixing roller 611. As shown in FIG. 20B, a tension roller 612 is provided inside the fixing belt 102, at an upper portion in the figure of the fixing device 100. The tension roller 612 supports the fixing belt 102 from the inside. As shown in FIG. 20B, the tension roller 612 includes a rotary shaft 612A arranged along the width direction of the fixing belt 102, and two disk-like members 612B attached to the rotary shaft 612A. In this exemplary embodiment, the disk-like members 612B are arranged at both end portions of the fixing belt 102 in the width direction of the fixing belt 102, and the both end portions in the width direction of the fixing belt 102 are supported by the tension roller 612.

In this exemplary embodiment, as shown in FIG. 20A, a heat supply member 613 is provided inside the fixing belt 102. The heat supply member 613 comes into contact with the fixing belt 102 and supplies heat to the fixing belt 102. Also, in this exemplary embodiment, an advance/retract mechanism 400 that causes the heat supply member 613 to advance to and retract from an inner peripheral surface of the fixing belt 102 is provided. In this exemplary embodiment, when the advance/retract mechanism 400 is turned ON and OFF, the heat supply member 613 comes into contact with the inner peripheral surface of the fixing belt 102, and is separated from the inner peripheral surface of the fixing belt 102. The advance/retract mechanism 400 may be formed of, for example, a motor or a solenoid. As described above, alternatively, the advance/retract mechanism 400 may be made of a shape memory alloy.

As shown in FIG. 20A, the heat supply member 613 is curved such that a cross-sectional shape thereof is an arc shape. Also, the heat supply member 613 includes a base member 613A that has a plate-like arc shape, is arranged near the fixing belt 102, and comes into contact with the fixing belt 102; and a sheet-like heating body (heat source) 613B that is arranged at the inner side of the fixing belt 102 with respect to the base member 613A and heats the base member 613A. Also, as shown in FIG. 20B, the heat supply member 613 is arranged between the two disk-like members 612B provided at the tension roller 612 and is arranged between the rotary shaft 612A and the fixing belt 102.

The fixing belt 102 according to this exemplary embodiment includes a base layer made of polyimide resin, an elastic body layer stacked on a surface (outer surface) of the base layer and made of silicon rubber, and a separate layer stacked on the elastic body layer and formed of a tube of tetrafluoroethylene perfluoroalkoxy vinyl ether copolymer (PFA). The fixing belt 102 rotates in a direction indicated by arrow 20A in FIG. 20A at a predetermined speed when receiving a driving force from the pressure roller 104.

The fixing roller 611 is hollow. To be more specific, the fixing roller 611 is a hard roller including a cylindrical core roller (core bar) made of aluminum and a protection layer that prevents metal from wearing at the surface of the core roller. Fluorocarbon resin coating is provided as the protection layer on the core roller. However, the configuration of the fixing roller 611 is not limited thereto, and may be a configuration functions as a roller that is hard enough so that the fixing roller 611 is hardly deformed by a pressing force from the pressure roller 104 when the nip part N is formed with respect to the pressure roller 104. Also, in this exemplary embodiment, a heater 616 (heat source) is arranged in the fixing roller 611. The temperature at the surface of the fixing roller 611 is controlled based on a measurement value of a temperature sensor (not shown) that is arranged to be in contact with the surface of the fixing roller 611.

Also, a bending member (not shown) that presses the fixing belt 102 from the inside and bends the fixing belt 102 may be provided inside the fixing belt 102, at a position located downstream of the nip part N. In this case, a sheet P is easily separated from the fixing belt 102 at a bent portion of the fixing belt 102 formed by the bending member. Also, a roller that presses the fixing belt 102 from the inner periphery side or the outer periphery side and applies a tension to the fixing belt 102 may be provided.

In this exemplary embodiment, the pressure roller 104 is rotated by a motor (not shown). In this exemplary embodiment, the transmission mechanism 300 transmits the driving force from the pressure roller 104 to the fixing belt 102. The transmitted driving force rotates the fixing belt 102.

The details of the transmission mechanism 300 will be described with reference to FIG. 21.

Figure 21:
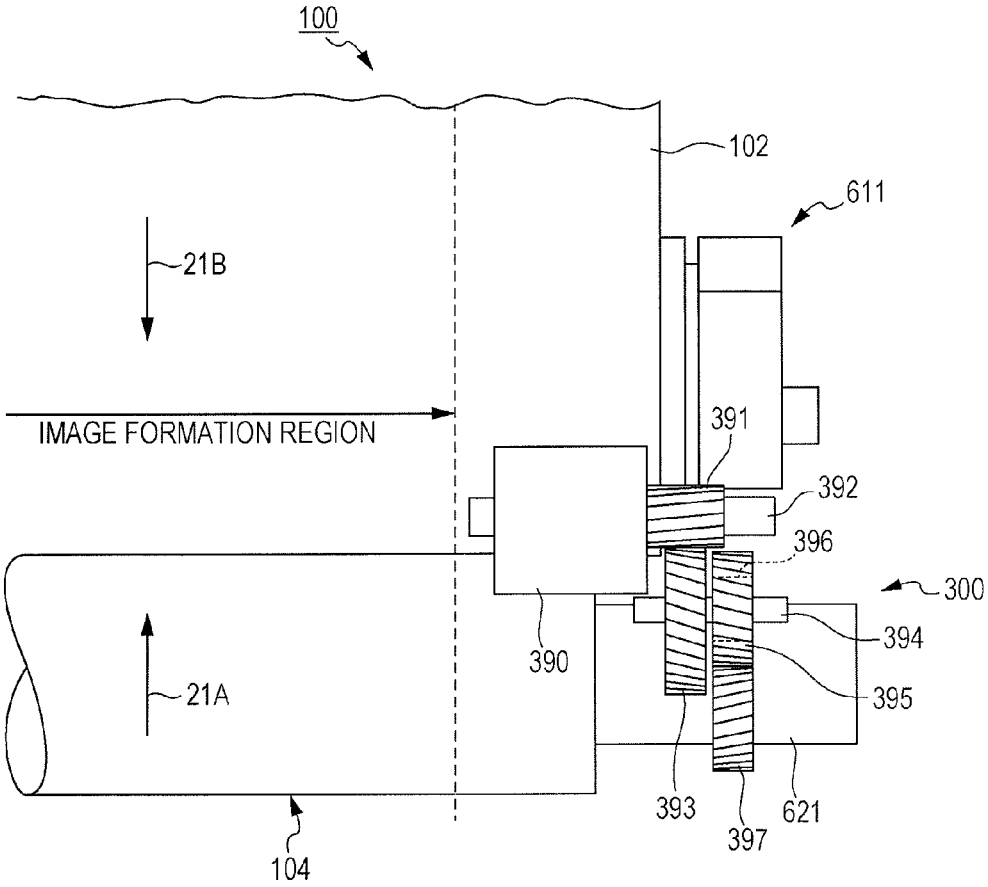
FIG. 21 is an illustration when a transmission mechanism is viewed from a direction indicated by arrow XXI in FIG. 20A.

FIG. 21 is an illustration when the transmission mechanism 300 is viewed from a direction indicated by arrow XXI in FIG. 20A.

As shown in FIG. 21, the transmission mechanism 300 includes a fixing-belt driving roller 390 that is in contact with the outer peripheral surface of the fixing belt 102 and rotationally drives the fixing belt 102; and a first transmission gear member 393 and a second transmission gear member 395 that transmit a rotational driving force from the pressure roller 104 to the fixing-belt driving roller 390. Although FIG. 21 illustrates the transmission mechanism 300 provided in a first end region of the fixing device 100, the transmission mechanism 300 is provided at each of both end regions of the fixing device 100 (FIG. 21 illustrates the transmission mechanism 300 in the first end region).

The fixing-belt driving roller 390 is arranged at a position outside an image formation region in the width direction of the fixing belt 102. Also, the fixing-belt driving roller 390 is pressed to the fixing belt 102 from the outer peripheral surface of the fixing belt 102. Further, the fixing-belt driving roller 390 is pressed to the fixing roller 611 through the fixing belt 102. The fixing-belt driving roller 390 includes a rotary shaft 392 and a gear 391 coaxially arranged with the rotary shaft 392. In this exemplary embodiment, the gear 391 obtains the rotational driving force from the pressure roller 104 through the first transmission gear member 393 and the second transmission gear member 395. Hence, the fixing-belt driving roller 390 rotates.

The first transmission gear member 393 and the second transmission gear member 395 are fixed coaxially with a rotary shaft 394, and are supported by a body of the fixing device 100 through the rotary shaft 394. The first transmission gear member 393 is coupled with the gear 391 of the fixing-belt driving roller 390 by gear coupling. Also, the second transmission gear member 395 is coupled with a gear 397 provided coaxially with a core bar 621 of the pressure roller 104 by gear coupling.

Accordingly, the rotational driving force of the pressure roller 104 is transmitted in a path of the gear 397 of the pressure roller 104, the second transmission gear member 395, the rotary shaft 394, the first transmission gear member 393, the gear 391 of the fixing-belt driving roller 390, the rotary shaft 392, and then the fixing-belt driving roller 390. In the fixing device 100 of this exemplary embodiment, a gear ratio of the gear 391 provided at the fixing-belt driving roller 390, the first transmission gear member 393, the second transmission gear member 395, and the gear 397 provided at the pressure roller 104 is determined such that the peripheral speed of the fixing-belt driving roller 390 is slightly lower than the peripheral speed of the pressure roller 104. This will be described later in detail.

Also, a one-way clutch 396 is arranged between the second transmission gear member 395 and the rotary shaft 394 coaxially with the rotary shaft 394. The one-way clutch 396 stops transmission of the rotational driving force from the pressure roller 104 to the fixing-belt driving roller 390 if the rotational torque of the fixing-belt driving roller 390 becomes larger than the rotational torque from the pressure roller 104. The one-way clutch 396 may be arranged at any position in the path from the gear 397 of the pressure roller 104 to the fixing-belt driving roller 390. For example, the one-way clutch 396 may be arranged between the first transmission gear member 393 and the rotary shaft 394, or between the gear 391 of the fixing-belt driving roller 390 and the rotary shaft 392.

The first transmission gear member 393 and the second transmission gear member 395 move together in accordance with a retract operation of the pressure roller 104 so as to maintain the gear coupling with the gear 391 of the fixing-belt driving roller 390 and the gear coupling with the gear 397 of the pressure roller 104. Accordingly, the fixing-belt driving roller 390 is rotated by obtaining the rotational driving force from the pressure roller 104 when the pressure roller 104 moves to the position separated from the fixing belt 102 and when the pressure roller 104 is set to the position at which the pressure roller 104 is pressed to the fixing belt 102 during an image forming operation.

In the fixing device 100 of this exemplary embodiment, the pressure roller 104 is arranged at the position separated from the fixing belt 102, for example, immediately after power is turned on. Accordingly, heat of the fixing belt 102 heated by the heater 616 (see FIG. 20A) provided in the fixing roller 611 is not transferred to the pressure roller 104. Also, immediately after power is turned on, the rotational driving force is transmitted from the pressure roller 104 to the fixing-belt driving roller 390 through the first transmission gear member 393 etc. Accordingly, the fixing-belt driving roller 390 is rotated, and the fixing belt 102 is rotated by the rotation.

In this exemplary embodiment, the fixing-belt driving roller 390 is in contact with the fixing belt 102 even during image formation. Hence, the fixing-belt driving roller 390 is arranged at the position outside the image formation region, the position which is not contained in the image formation region of the fixing belt 102. Accordingly, a phenomenon in which a toner is transferred to the surface of the fixing-belt driving roller 390 and solidified does not occur, and a frictional force between the fixing-belt driving roller 390 and the fixing belt 102 is maintained.

In this exemplary embodiment, as described above, the peripheral speed of the fixing-belt driving roller 390 is slightly lower than the peripheral speed of the pressure roller 104. Further, in the path from the gear 397 of the pressure roller 104 to the fixing-belt driving roller 390, if the rotational torque of the fixing-belt driving roller 390 becomes larger than the rotational torque from the pressure roller 104, the one-way clutch 396 stops transmission of the rotational driving force from the pressure roller 104 to the fixing-belt driving roller 390.

The pressure roller 104 is arranged to face the fixing belt 102, and rotates in a direction indicated by arrow 21A by a driving motor (not shown). During image formation, the fixing belt 102 is driven by the pressure roller 104 as the result of the rotation, and rotationally moves (in a direction indicated by arrow 21B). When a sheet P holding an unfixed toner image passes through the nip part N, the toner image is fixed to the sheet P. Hence, to restrict occurrence of a disorder of an image, such as a misalignment of a toner image, the pressure roller 104 and the fixing belt 102 have to move at equivalent speeds at the nip part N.

In this case, if the peripheral speed of the fixing-belt driving roller 390 is completely equivalent to the peripheral speed of the pressure roller 104, the moving speed of the fixing belt 102 does not have to be changed at the nip part N. However, the pressure roller 104 may have, for example, a variation in dimension and a variation in hardness. Also, the fixing-belt driving roller 390 may have a variation in dimension etc. Further, the dimension of the pressure roller 104 and the dimension of the fixing-belt driving roller 390 may vary with temperature. Owing to this, in general, the peripheral speed of the fixing-belt driving roller 390 is not completely equivalent to the peripheral speed of the pressure roller 104.

Owing to this, in the fixing device 100 of this exemplary embodiment, the peripheral speed of the fixing-belt driving roller 390 is set to be slightly lower than the peripheral speed of the pressure roller 104. With this setting, even if a variation in dimension and a variation with temperature appear, the setting in which the peripheral speed of the fixing-belt driving roller 390 is slightly lower than the peripheral speed of the pressure roller 104 is not changed. Hence, the peripheral speed of the fixing-belt driving roller 390 is constantly lower than the moving speed of the fixing belt 102.

Accordingly, during image formation, the fixing-belt driving roller 390 may obtain the driving force from the fixing belt 102, and the rotational torque of the fixing-belt driving roller 390 becomes larger than the rotational torque from the pressure roller 104. Then, the one-way clutch 396 is operated, transmission of the rotational driving force from the pressure roller 104 to the fixing-belt driving roller 390 is stopped, and the fixing-belt driving roller 390 is brought into a no-load state. The fixing-belt driving roller 390 is driven by the fixing belt 102, and an influence to the moving speed of the fixing belt 102 at the nip part N is markedly reduced.

During warm-up, when the fixing-belt driving roller 390 rotates the fixing belt 102, the peripheral speed of the fixing-belt driving roller 390 becomes equivalent to the moving speed of the fixing belt 102. Hence, the rotational torque of the fixing-belt driving roller 390 does not become larger than the rotational torque from the pressure roller 104. The one-way clutch 396 is not operated, and the rotational driving force is constantly transmitted from the pressure roller 104 to the fixing-belt driving roller 390.

A series of operations of the fixing device 100 according to this exemplary embodiment is described.

When power is turned on, the control unit 50 (see FIG. 1) drives the motor (not shown) to rotate the pressure roller 104. When the pressure roller 104 is rotated, the rotational driving force is transmitted from the pressure roller 104 to the fixing belt 102 through the transmission mechanism 300, and thus the fixing belt 102 is rotated. Also, the control unit 50 supplies electric power to the heating body 613B provided at the heat supply member 613. Thus, the heating body 613B generates heat. The heat is transferred from the heating body 613B to the heat supply member 613 (the base member 613A of the heat supply member 613), and the heat supply member 613 is heated.

Further, the control unit 50 turns on the heater 616 provided in the fixing roller 611. Accordingly, the fixing belt 102 is heated. In particular, the fixing belt 102 is heated by the fixing roller 611 that is heated by the heater 616. To be more specific, heat is transferred from the heater 616 to the fixing roller 611, and heat is transferred from the fixing roller 611 to the fixing belt 102. Thus, the temperature of the fixing belt 102 increases. At this time, the heat supply member 613 is separated from the fixing belt 102. Also, the pressure roller 104 is separated from the fixing belt 102. Hence, the heat of the fixing belt 102 is not reduced by the heat supply member 613 and the pressure roller 104. In this case, similarly to the above-described configuration, the temperature of the fixing belt 102 increases quickly, and a time required until the fixing processing becomes available for a first sheet P decreases.

Then, in this exemplary embodiment, when the temperature of the fixing belt 102 reaches the fixing set temperature, the retract mechanism (not shown) is driven, and the pressure roller 104 comes into contact with the fixing belt 102. Then, a sheet P is fed to the fixing device 100, and the fed sheet P is heated and pressed by the fixing belt 102 at the predetermined fixing set temperature and the pressure roller 104. Accordingly, a toner image is fixed to the sheet P.

In this exemplary embodiment, similarly to the above-described configuration, when the fixing processing is performed for a first sheet P, the heat of the fixing belt 102 is reduced by the fixing belt 102. Also, when second and later sheets P are successively supplied, the heat of the fixing belt 102 is further reduced. Accordingly, even in this exemplary embodiment, as the fixing processing is continuously performed for the sheets P, the temperature of the fixing belt 102 gradually decreases. Meanwhile, in this exemplary embodiment, the heat supply member 613 is heated in a state in which the heat supply member 613 is separated from the fixing belt 102. Thus, in the fixing device 100 of this exemplary embodiment, the temperature of the fixing belt 102 decreases whereas the temperature of the heat supply member 613 increases.

In this exemplary embodiment, the advance/retract mechanism 400 is turned on after a predetermined number of sheets P pass through the nip part N, and the heat supply member 613 comes into contact with the inner peripheral surface of the fixing belt 102. Hence, the heat of the heat supply member 613 is supplied to the fixing belt 102, and the fixing belt 102 is heated by the heat supply member 613. Then, in this exemplary embodiment, the number of rotations of the motor that drives the pressure roller 104 is increased. Accordingly, the number of rotations of the pressure roller 104 and the number of rotations of the fixing belt 102 are increased and the number of sheets P available for fixing per unit time is increased. In particular, the moving speed of the fixing belt 102 moving at a first speed becomes a second speed higher than the first speed, and hence the number of sheets P available for fixing per unit time is increased. In this case, similarly to the above-described configuration, the driving speeds of respective mechanisms provided in the printer 10 are increased. Accordingly, productivity of the entire printer 10 increases.

In this exemplary embodiment, the heat supply member 613 at a higher temperature than the temperature of the fixing belt 102 comes into contact with the fixing belt 102 during fixing processing. Accordingly, the heat is supplied to the fixing belt 102, the temperature of which has been reduced. Even when plural sheets P are continuously transported, the fixing processing may be performed for the sheets P. In particular, in this exemplary embodiment, since heat is supplied in the mid course, the fixing processing is performed at a higher speed.

In the above description, the heat supply member 613 has a plate-like shape and is curved so as to form an arc. However, the configuration is not limited thereto. For example, a rotatable cylindrical roller-like member and a heater arranged in the roller-like member may form the heat supply member 613.

In the above description, by providing the transmission mechanism 300, the fixing belt 102 is rotated. However, for example, if a motor (hereinafter, referred to as "tension-roller motor") for rotationally driving the tension roller 612 is provided in addition to the motor for rotating the pressure roller 104, the fixing belt 102 is rotated immediately after power is turned on without the transmission mechanism 300. In this case, if the fixing belt 102 comes into contact with the pressure roller 104, a load torque applied to the tension-roller motor increases. Hence, it is desirable that driving of the tension-roller motor is stopped after the fixing belt 102 comes into contact with the pressure roller 104, and the fixing belt 102 is rotated by the motor for rotating the pressure roller 104.

In the above-described fixing device 100, when power is turned on and heating processing of the fixing belt 102 is performed (when warm-up processing is performed), the temperature-sensitive magnetic member 114 or the heat supply member 613 (hereinafter, referred to as "temperature-sensitive magnetic member 114 etc.") are separated from the inner peripheral surface of the fixing belt 102, and the temperature-sensitive magnetic member 114 etc. separated from the inner peripheral surface of the fixing belt 102 is heated. In this processing, as described above, fixing processing for an image to a sheet P is started, then the heated temperature-sensitive magnetic member 114 etc. is brought into contact with the fixing belt 102 to supply heat to the fixing belt 102.

Meanwhile, for example, if a heat capacity of the temperature-sensitive magnetic member 114 etc. is large, even if the heating processing is performed for the temperature-sensitive magnetic member 114 etc., the temperature-sensitive magnetic member 114 etc. may not be quickly heated. In such a case, the temperature-sensitive magnetic member 114 etc. at a low temperature may come into contact with the fixing belt 102. In this case, it is difficult to supply heat from the temperature-sensitive magnetic member 114 etc. to the fixing belt 102. Also in this case, the heat of the fixing belt 102 may be reduced by the temperature-sensitive magnetic member 114 etc.

In particular, if the temperature-sensitive magnetic member 114 etc. is brought into contact with the fixing belt 102 while the temperature of the temperature-sensitive magnetic member 114 etc. is not equivalent to or higher than the temperature of the fixing belt 102, the heat of the fixing belt 102 is reduced by the temperature-sensitive magnetic member 114 etc., resulting in that the temperature of the fixing belt 102 decreases. If the temperature-sensitive magnetic member 114 etc. is brought into contact with the fixing belt 102 after the temperature-sensitive magnetic member 114 etc. is sufficiently heated, occurrence of such a trouble is restricted. However, in this case, the speed (the number of rotations) of the fixing belt 102 may not be increased until the temperature-sensitive magnetic member 114 etc. is sufficiently heated. Productivity of the fixing processing decreases.

Owing to this, for example, during warm-up of the fixing device 100, the temperature-sensitive magnetic member 114 etc. may be brought into contact with the fixing belt 102 for a predetermined time (for example, three seconds) (or the temperature-sensitive magnetic member 114 etc. may be brought into contact with the fixing belt 102 until the temperature of the temperature-sensitive magnetic member 114 etc. reaches a predetermined temperature), and the temperature-sensitive magnetic member 114 etc. may be heated by the fixing belt 102. For the contact, a portion of the temperature-sensitive magnetic member 114 etc. facing the fixing belt 102 may be entirely brought into contact with the fixing belt 102, or the portion facing the fixing belt 102 may be partly brought into contact with the fixing belt 102.

After the temperature-sensitive magnetic member 114 etc. is brought into contact with the fixing belt 102 for the predetermined time, the temperature-sensitive magnetic member 114 etc. is separated from the fixing belt 102. If the temperature-sensitive magnetic member 114 etc. is continuously in contact with the fixing belt 102, heat of the fixing belt 102 is continuously reduced by the temperature-sensitive magnetic member 114 etc., and a time required until fixing processing for a first sheet P becomes available may be long.

As described above, if the temperature-sensitive magnetic member 114 etc. is in contact with the fixing belt 102 for the predetermined time, heat is supplied from the fixing belt 102 to the temperature-sensitive magnetic member 114 etc. As compared with a case in which the temperature-sensitive magnetic member 114 etc. is initially separated from the fixing belt 102, the temperature of the temperature-sensitive magnetic member 114 etc. quickly increases. In this case, the temperature-sensitive magnetic member 114 at a low temperature hardly comes into contact with the fixing belt 102. Also, if the temperature of the temperature-sensitive magnetic member 114 etc. quickly increases, the temperature-sensitive magnetic member 114 etc. may be brought into contact with the fixing belt 102 at an earlier timing. Thus, the number of rotations of the fixing belt 102 may be increased at an earlier timing.

If a next fixing instruction is made immediately after the temperature-sensitive magnetic member 114 etc. performs a fixing operation, the temperature of the temperature-sensitive magnetic member 114 etc. may be already high by residual heat of the fixing operation. Hence, the time for the contact of the temperature-sensitive magnetic member 114 etc. may be short (for example, 1.5 seconds), or the temperature may not be required to be increased by the contact. Further, for example, immediately after the continuous fixing operations, if the temperature of the temperature-sensitive magnetic member 114 etc. is at the fixing set temperature of the fixing belt 102, the fixing operation becomes available in the contact state (without separation). In this case, the number of sheets P available for fixing per unit time may be increased from an initial stage of fixing.

An operation after the temperature-sensitive magnetic member 114 etc. is separated from the fixing belt 102 (an operation after the temperature-sensitive magnetic member 114 etc. is heated by the fixing belt 102) is similar to the operation described above. After a predetermined number of sheets P pass through the nip part (contact part between the fixing belt 102 and the pressure roller 104) and then the temperature-sensitive magnetic member 114 etc. comes into re-contact with the inner peripheral surface of the fixing belt 102. Hence, the heat of the temperature-sensitive magnetic member 114 etc. is supplied to the fixing belt 102, and the fixing belt 102 is heated by the temperature-sensitive magnetic member 114 etc. Then, similarly to the above-described configuration, the number of rotations of the fixing belt 102 is increased and the number of sheets P available for fixing per unit time is increased.

Although not described above, a sensor that detects the temperature of the temperature-sensitive magnetic member 114 etc. may be provided, and after the temperature of the temperature-sensitive magnetic member 114 etc. becomes a predetermined temperature or higher, the temperature-sensitive magnetic member 114 etc. separated from the inner peripheral surface of the fixing belt 102 may be brought into contact with the inner peripheral surface of the fixing belt 102. In this case, the temperature-sensitive magnetic member 114 etc. at a low temperature is reliably prevented from coming into contact with the inner peripheral surface of the fixing belt 102. In the above description, the temperature-sensitive magnetic member 114 etc. is temporarily brought into contact with the inner peripheral surface of the fixing belt 102 and the temperature-sensitive magnetic member 114 etc. is heated by the fixing belt 102. However, similar processing may be performed by the heating device 200 described with reference to FIGS. 15A and 15B. Specifically, the temperature-sensitive magnetic member 206 may be temporarily brought into contact with the heating belt 204, and the temperature-sensitive magnetic member 206 may be heated by using the heating belt 204.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device, comprising:

a fixing member that is able to circulate and fixes an image on a recording material to the recording material;

a heated member that is at least partly separated from the fixing member;

a heating unit that heats the fixing member and the heated member;

a heated-member moving unit that moves the heated member toward the fixing member; and a fixing-member moving unit that moves the fixing member at a first speed, and moves the fixing member at a second speed higher than the first speed after the heated member is moved, wherein the fixing-member moving unit moves the fixing member at the second speed and then moves the fixing member at a third speed higher than the second speed, and wherein the fixing device further includes a power supply unit that supplies predetermined electric power to the heating unit when the fixing member is moved at the second speed, and supplies higher electric power than the predetermined electric power to the heating unit when the fixing member is moved at the third speed.

2. The fixing device according to claim 1, wherein the heated-member moving unit moves the heated member toward the fixing member by using a deformable member that is deformed when the deformable member receives heat.

3. The fixing device according to claim 2, wherein the deformable member is formed of a shape memory alloy.

4. The fixing device according to claim 1, wherein the fixing member is separated from the heated member before the heated-member moving unit moves the heated member.

5. The fixing device according to claim 1, wherein the heating unit includes a heat source and heats the fixing member by transferring heat from the heat source to the fixing member, and wherein the heated member is heated by transferring heat from a heat source provided for the heated member to the heated member.

6. The fixing device according to claim 1, wherein the fixing member includes a conductive layer that is able to be heated by electromagnetic induction, wherein the heating unit heats the fixing member by generating an alternating magnetic field that intersects with the conductive layer of the fixing member, and wherein the heated member is heated by using the alternating magnetic field generated by the heating unit.

7. A heating device, comprising:

a supply member that is able to circulate and supplies heat to a heated body;

a heated member that is at least partly separated from the supply member;

a heating unit that heats the supply member and the heated member;

a heated-member moving unit that moves the heated member toward the supply member; and a supply-member moving unit that moves the supply member at a first speed, and moves the supply member at a second speed higher than the first speed after the heated member is moved, wherein the fixing-member moving unit moves the fixing member at the second speed and then moves the fixing member at a third speed higher than the second speed, and wherein the fixing device further includes a power supply unit that supplies predetermined electric power o h heating unit when the fixing member is moved at the second speed, and supplies higher electric power than the predetermined electric power to the heating unit when the fixing member is moved at the third speed.

8. An image forming apparatus, comprising:

an image forming unit that forms an image on a recording material;

a fixing member that is able to circulate and fixes the image formed on the recording material by the image forming unit to the recording material;

a heated member that is at least partly separated from the fixing member;

a heating unit that heats the fixing member and the heated member;

a heated-member moving unit that moves the heated member toward the fixing member; and a fixing-member moving unit that moves the fixing member at a first speed, and moves the fixing member at a second speed higher than the first speed after the heated member is moved, wherein the fixing-member moving unit moves the fixing member at the second speed and then moves the fixing member at a third speed higher than the second speed, and wherein the fixing device further includes a power supply unit that supplies predetermined electric power to the heating unit when the fixing member is moved at the second speed, and supplies higher electric power than the predetermined electric power to the heating unit when the fixing member is moved at the third speed.

9. A fixing device, comprising:

a fixing member that is able to circulate and fixes an image on a recording material to the recording material;

a heated member that is able to advance to and retract from the fixing member;

a heating unit that heats the fixing member and the heated member;

a heated-member moving unit that brings at least part of the heated member into contact with the fixing member heated by the heating unit for a predetermined time or until a temperature of the heated member reaches a predetermined temperature before the fixing member performs fixing processing of the image to the recording material, separates the heated member from the fixing member after the predetermined time elapses or after the temperature of the heated member reaches the predetermined temperature, and brings the heated member into re-contact with the fixing member after the fixing member starts the fixing processing of the image to the recording material; and a fixing-member moving unit that moves the fixing member at a first speed before the heated member is brought into re-contact with the fixing member, and moves the fixing member at a second speed higher than the first speed after the heated member is brought into re-contact with the fixing member.

10. The fixing device according to claim 9, wherein the heated-member moving unit brings the heated member into re-contact with the fixing member after the fixing member starts the fixing processing of the image to the recording material and after the temperature of the heated member heated by the heating unit reaches the predetermined temperature.

11. The fixing device according to claim 9, wherein the predetermined time is changed in accordance with the temperature of the heated member.

12. The fixing device according to claim 9, wherein whether the heated member is continuously brought into contact with the fixing member or separated from the fixing member is controlled in accordance with the temperature of the heated member.

13. A heating device, comprising:

a supply member is able to circulate and supplies heat to a heated body;

a heated member that is able to advance to and retract from the supply member;

a heating unit that heats the supply member and the heated member;

a heated-member moving unit that brings at least part of the heated member into contact with the supply member heated by the heating unit for a predetermined time or until a temperature of the heated member reaches a predetermined temperature before the supply member performs heating processing of the heated body, separates the heated member from the supply member after the predetermined time elapses or after the temperature of the heated member reaches the predetermined temperature, and brings the heated member into re-contact with the supply member after the supply member starts the heating processing of the heated body; and a supply-member moving unit that moves the supply member at a first speed before the heated member is brought into re-contact with the supply member, and moves the supply member at a second speed higher than the first speed after the heated member is brought into re-contactwith the supply member.

14. The heating device according to claim 13, wherein the predetermined time is changed in accordance with the temperature of the heated member.

15. The heating device according to claim 13, wherein whether the heated member is continuously brought into contact with the supply member or separated from the supply member is controlled in accordance with the temperature of the heated member.

16. An image forming apparatus, comprising:

an image forming unit that forms an image on a recording material;

a fixing member that is able to circulate and fixes the image formed on the recording material by the image forming unit to the recording material;

a heated member that is able to advance to and retract from the fixing member;

a heating unit that heats the fixing member and the heated member;

a heated-member moving unit that brings at least part of the heated member into contact with the fixing member heated by the heating unit for a predetermined time or until a temperature of the heated member reaches a predetermined temperature before the fixing member performs fixing processing of the image to the recording material, separates the heated member from the fixing member after the predetermined time elapses or after the temperature of the heated member reaches the predetermined temperature, and brings the heated member into re-contact with the fixing member after the fixing member starts the fixing processing of the image to the recording material; and a fixing-member moving unit that moves the fixing member at a first speed before the heated member is brought into re-contact with the fixing member, and moves the fixing member at a second speed higher than the first speed after the heated member is brought into re-contact with the fixing member.

17. The image forming apparatus according to claim 16, wherein the predetermined time is changed in accordance with the temperature of the heated member.

18. The image forming apparatus according to claim 16, wherein whether the heated member is continuously brought into contact with the fixing member or separated from the fixing member is controlled in accordance with the temperature of the heated member.

* * * * *